US008874441B2

(12) United States Patent
Zhang et al.

(10) Patent No.: US 8,874,441 B2
(45) Date of Patent: Oct. 28, 2014

(54) NOISE SUPPRESSION USING MULTIPLE SENSORS OF A COMMUNICATION DEVICE

(75) Inventors: Xianxian Zhang, San Diego, CA (US); Jes Thyssen, San Juan Capistrano, CA (US); Kwan Young Shin, San Diego, CA (US)

(73) Assignee: Broadcom Corporation, Irvine, CA (US)

( * ) Notice: Subject to any disclaimer, the term of this patent is extended or adjusted under 35 U.S.C. 154(b) by 670 days.

(21) Appl. No.: 13/174,964

(22) Filed: Jul. 1, 2011

(65) Prior Publication Data

US 2012/0185246 A1 Jul. 19, 2012

Related U.S. Application Data

(60) Provisional application No. 61/434,314, filed on Jan. 19, 2011.

(51) Int. Cl.
*G10L 21/02* (2013.01)

(52) U.S. Cl.
USPC ..... 704/233; 704/226; 379/392.01

(58) Field of Classification Search
USPC ..... 704/226, 233; 379/392.01
See application file for complete search history.

(56) References Cited

U.S. PATENT DOCUMENTS 7,107,210 B2 * 9/2006 Deng et al. ..... 704/226
2006/0206322 A1 * 9/2006 Deng et al. ..... 704/226
2007/0106504 A1 * 5/2007 Deng et al. ..... 704/226
2009/0012786 A1 1/2009 Zhang et al.
2010/0076759 A1 * 3/2010 Shinohara et al. ..... 704/233
2012/0130710 A1 * 5/2012 Li et al. ..... 704/231

OTHER PUBLICATIONS

Wilson et al., "Regularized Non-Negative Matrix Factorization with Temporal Dependencies for Speech Denoising", In proceedings of Interspeech 2008, Brisbane, Australia, Sep. 22-26, 2008, pp. 411-414.

Kim et al., "An Algorithm that Improves Speech Intelligibility in Noise for Normal-hearing Listeners", Journal of the Acoustical Society of America, vol. 126, No. 3, Sep. 2009, pp. 1486-1494.

Tchorz et al., "SNR Estimation Based on Amplitude Modulation Analysis with Applications to Noise Suppression", IEEE Transactions on Speech and Audio Processing, vol. 11, No. 3, May 2003, pp. 184-192.

* cited by examiner

*Primary Examiner* — Daniel D Abebe
(74) *Attorney, Agent, or Firm* — Fiala & Weaver P.L.L.C.

(57) ABSTRACT

Techniques are described herein that suppress noise using multiple sensors (e.g., microphones) of a communication device. Noise modeling (e.g., estimation of noise basis vectors and noise weighting vectors) is performed with respect to a noise signal during operation of a communication device to provide a noise model. The noise model includes noise basis vectors and noise coefficients that represent noise provided by audio sources other than a user of the communication device. Speech modeling (e.g., estimation of speech basis vectors and speech weighting) is performed to provide a speech model. The speech model includes speech basis vectors and speech coefficients that represent speech of the user. A noisy speech signal is processed using the noise basis vectors, the noise coefficients, the speech basis vectors, and the speech coefficients to provide a clean speech signal.

20 Claims, 13 Drawing Sheets

NOISE SUPPRESSION USING MULTIPLE SENSORS OF A COMMUNICATION DEVICE

CROSS-REFERENCE TO RELATED APPLICATIONS

This application claims the benefit of U.S. Provisional Application No. 61/434,314, filed Jan. 19, 2011, the entirety of which is incorporated by reference herein.

BACKGROUND OF THE INVENTION

1. Field of the Invention

The invention generally relates to noise suppression.

2. Background

Electronic voice communication via communication devices such as cellular telephones, personal digital assistants, etc. is becoming common in an ever increasing range of environments. Such environments often are characterized by non-stationary noise. Conventional noise suppression techniques typically are not capable of suppressing such non-stationary noise. For instance, conventional single channel noise suppression techniques such as spectral subtraction and Wiener filtering rely on stationarity of the noise in order to estimate it and therefore typically are restricted to handling stationary or quasi-stationary noise in practice.

Single-channel nonnegative matrix factorization (SNMF) is one exemplary technique that has been proposed for suppressing non-stationary noise. SNMF is based on a matrix equation that may be represented as $V \approx WH$. A locally optimal choice of W and H are determined to solve the matrix equation for nonnegative V, W, and H. The signal, V, is a spectrogram. W is a set of specific spectral shapes or basis vectors (a.k.a. building blocks) that define a model of an audio source. H is a set of time-varying activation levels of the respective building blocks.

However, SNMF has limitations. For instance, SNMF relies upon noise information (noise modeling) as a priori knowledge, which limits its application in practice as the noise environment changes. Such changes in the noise environment typically are not known or predictable before the SNMF technique is performed.

BRIEF SUMMARY OF THE INVENTION

A system and/or method for suppressing noise using multiple sensors (e.g., microphones) of a communication device, substantially as shown in and/or described in connection with at least one of the figures, as set forth more completely in the claims.

BRIEF DESCRIPTION OF THE DRAWINGS/FIGURES

The accompanying drawings, which are incorporated herein and form part of the specification, illustrate embodiments of the present invention and, together with the description, further serve to explain the principles involved and to enable a person skilled in the relevant art(s) to make and use the disclosed technologies.

Figure 2:
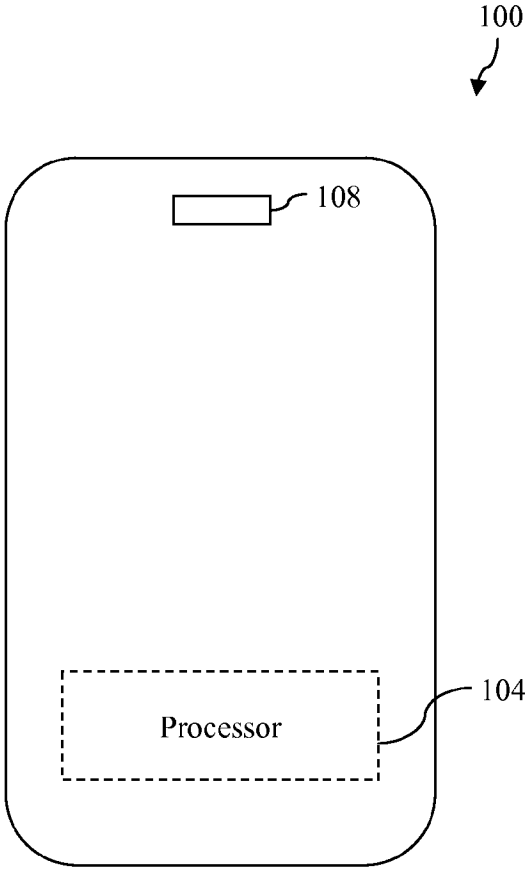
FIGS. 1 and 2 depict respective front and back views of an example communication device in accordance with embodiments described herein.

The features and advantages of the disclosed technologies will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

I. Introduction

The following detailed description refers to the accompanying drawings that illustrate example embodiments of the present invention. However, the scope of the present invention is not limited to these embodiments, but is instead defined by the appended claims. Thus, embodiments beyond those shown in the accompanying drawings, such as modified versions of the illustrated embodiments, may nevertheless be encompassed by the present invention.

References in the specification to "one embodiment," "an embodiment," "an example embodiment," or the like, indicate that the embodiment described may include a particular feature, structure, or characteristic, but every embodiment may not necessarily include the particular feature, structure, or characteristic. Moreover, such phrases are not necessarily referring to the same embodiment. Furthermore, when a particular feature, structure, or characteristic is described in connection with an embodiment, it is submitted that it is within the knowledge of one skilled in the art to implement such feature, structure, or characteristic in connection with other embodiments whether or not explicitly described.

Various approaches are described herein for, among other things, suppressing noise using multiple sensors (e.g., microphones) of a communication device. An example method is described in which at least noise basis vectors are estimated with respect to a noise signal that is received from a first sensor of a communication device that is configured to be distal a mouth of a user during operation of the communication device to provide a noise model that represents noise provided by audio sources other than the user. Speech basis vectors, speech weights that correspond to the speech basis vectors, and noise weights that correspond to the noise basis vectors are estimated based on a noisy speech signal that is received from a second sensor of the communication device that is configured to be proximate the mouth of the user during the operation of the communication device using a non-negative matrix factorization technique. The noisy speech signal represents a combination of speech and the noise. A clean speech signal is estimated based on the speech weights. The clean speech signal may be estimated further based on the speech basis vectors and the noise basis vectors. The clean speech signal represents the speech without the noise.

Another example method is described. In accordance with this method, noise basis vectors with respect to a noise signal that is part of a noisy speech signal are estimated. The noisy speech signal represents a combination of noise and speech. Speech basis vectors are estimated with respect to a clean speech signal that is part of the noisy speech signal. Speech weights that correspond to the speech basis vectors and noise weights that correspond to the noise basis vectors are estimated based on the noisy speech signal, the noise basis vectors, and the speech basis vectors using a non-negative matrix factorization technique. The clean speech signal is estimated based on the speech weights. The clean speech signal may be estimated further based on the speech basis vectors and the noise basis vectors. The clean speech signal represents the speech without the noise.

Yet another example method is described. In accordance with this method, noise basis vectors are estimated with respect to a noise signal that is part of a noisy speech signal. The noisy speech signal represents a combination of noise and speech. Estimating the noise basis vectors includes applying a blocking matrix to multiple signals that are received from multiple respective sensors of a communication device to suppress indications of the speech therein to obtain an estimate of the noise signal. The multiple signals include the noisy speech signal. Speech basis vectors, speech weights that correspond to the speech basis vectors, and noise weights that correspond to the noise basis vectors are estimated based on the noisy speech signal and further based on the noise basis vectors using a non-negative matrix factorization technique. A clean speech signal is estimated based on the speech weights. The clean speech signal may be estimated further based on the speech basis vectors and the noise basis vectors. The clean speech signal represents the speech without the noise.

The noise reduction techniques described herein have a variety of benefits as compared to conventional noise reduction techniques. For instance, the techniques described herein may reduce distortion of a primary or speech signal and/or reduce noise (e.g., background noise, babble noise, etc.) that is associated with the primary or speech signal more than conventional techniques. The techniques described herein may not rely upon predetermined signal and/or noise estimates for performing noise and/or speech modeling. The techniques may be capable of adapting to a changing noise environment. For instance, the techniques may be capable of providing a clean speech signal that takes into consideration non-stationary noise in real-time during operation of the communication device. Accordingly, the techniques may be capable of reducing stationary noise and non-stationary noise. The techniques may utilize multiple sensors (e.g., microphones) of the communication device. For instance, a secondary sensor of the communication device may be employed for detecting reference noise which is used for generating a noise model in accordance with some embodiments.

II. Example Noise Reduction Embodiments

Figure 1:
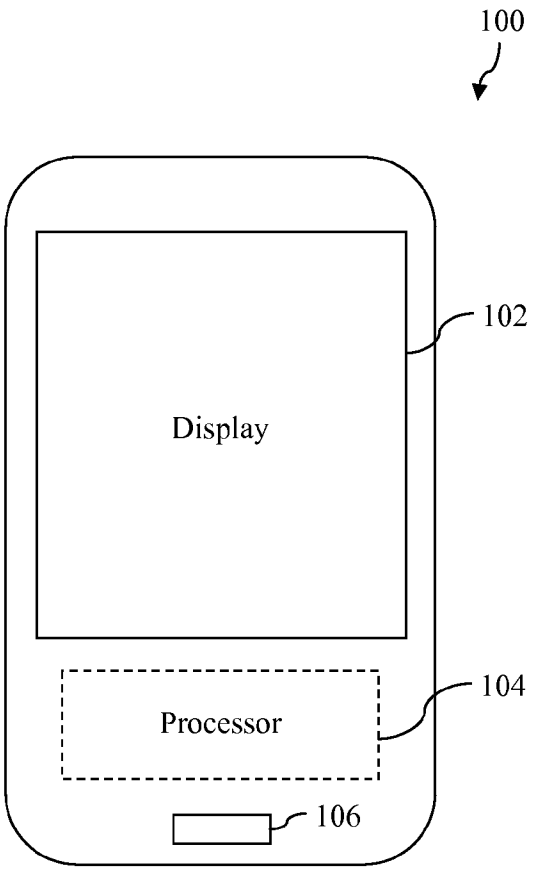

FIGS. 1 and 2 depict respective front and back views of an example handset of a communication device 100 in accordance with embodiments described herein. For example, communication device 100 may be a personal digital assistant, (PDA), a cellular telephone, etc. As shown in FIG. 1, a front portion of communication device 100 includes a display 102 and a second sensor 106 (e.g., a second microphone). Display 102 is configured to display images to a user of communication device 100. Second sensor 106 is positioned to be proximate the user's mouth during regular use of communication device 100. Accordingly, second sensor 106 is positioned to detect the user's speech. It can therefore be said that second sensor 106 is configured as a primary sensor during regular use of communication device 100.

As shown in FIG. 2, a back portion of communication device 100 includes a first sensor 108 (e.g., a first microphone). First sensor 108 is positioned to be farther from the user's mouth during regular use than second sensor 106. For instance, first sensor 108 may be positioned as far from the user's mount during regular use as possible. It can therefore be said that first sensor 108 is configured as a secondary sensor during regular use of communication device 100.

By positioning second sensor 106 so that it is closer to the user's mouth than first sensor 108 during regular use, a magnitude of the user's speech that is detected by second sensor 106 is likely to be greater than a magnitude of the user's speech that is detected by first sensor 108. It will be recognized that second sensor 106 is described as being closer to the user's mouth than first sensor 108 for illustrative purposes and is not intended to be limiting. Second sensor 106 and first sensor 108 may be at any suitable distances from the user's mouth.

Communication device 100 includes a processor 104 that is configured to perform noise modeling (e.g., on-line noise modeling) with respect to a noise signal that is detected by first sensor 108 during operation of communication device 100 (e.g., during a conversation of the user) to provide a noise model. Processor 104 is further configured to perform speech modeling with respect to an audio signal to provide a speech model. The audio signal may represent clean speech of the user or noisy speech of the user. In one example, the audio signal may be a representation of the user's speech that is recorded prior to the operation of communication device 100. In another example, second sensor 106 may detect the audio signal during the operation of communication device 100. Processor 104 is further configured to process a noisy speech signal based on the noise model and the speech model to provide a clean speech signal. The noisy speech signal represents a combination of the speech of the user and noise. The clean speech signal represents the speech of the user without the noise.

In accordance with an example embodiment, second sensor 106 detects the noisy speech signal for a first duration that includes a designated time period. First sensor 108 detects the noise signal for a second duration that includes the designated time period. In accordance with this embodiment, the first duration and the second duration overlap with respect to the designated time period.

Second sensor 106 and first sensor 108 are shown to be positioned on the respective front and back portions of communication device 100 in FIGS. 1 and 2 for illustrative purposes and are not intended to be limiting. Persons skilled in the relevant art(s) will recognize that second sensor 106 and first sensor 108 may be positioned in any suitable locations on communication device 100. For example, second sensor 106 may be configured on a bottom surface or a side surface of communication device 100. In another example, first sensor 108 may be configured on a top surface or a side surface of communication device 100. Nevertheless, the effectiveness of some techniques described herein may be improved if second sensor 106 and first sensor 108 are positioned on communication device 100 such that second sensor 106 is closer to the user's mouth during regular use of communication device 100 than first sensor 108.

One second sensor 106 is shown in FIG. 1 for illustrative purposes and is not intended to be limiting. It will be recognized that communication device 100 may include any number of primary sensors. One first sensor 108 is shown in FIG. 2 for illustrative purposes and is not intended to be limiting. It will be recognized that communication device 100 may include any number of secondary sensors.

Processor 104, second sensor 106, and first sensor 108 are described above as being included in a handset of communication device 100 for illustrative purposes and are not intended to be limiting. It will be recognized that processor 104, second sensor 106, and/or first sensor 108 may be included in a headset, an earpiece, headphones, earbud(s), or other element that is included in communication device 100. For instance, such an element may be coupled to the handset or another portion of communication device 100 via a wireless and/or wired connection. It will be further recognized that communication device 100 need not include a handset at all. For instance, communication device 100 may be a tablet computer, a laptop computer, a desktop computer, etc. Communication device 100 may be any suitable wireless or wired communication device.

Figure 3:
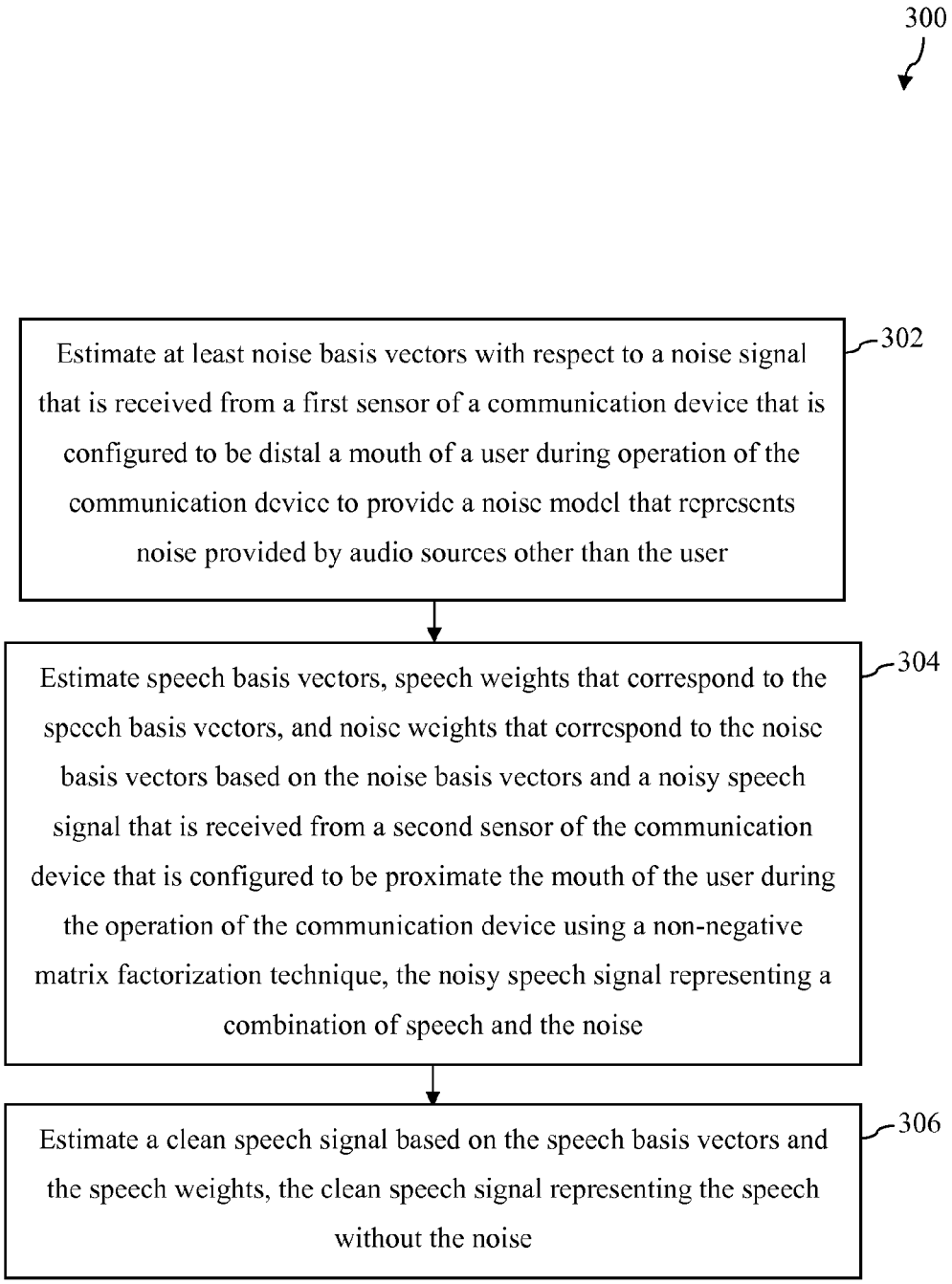
FIGS. 3-5 depict flowcharts of example methods for reducing noise in accordance with embodiments described herein.
Figure 4:
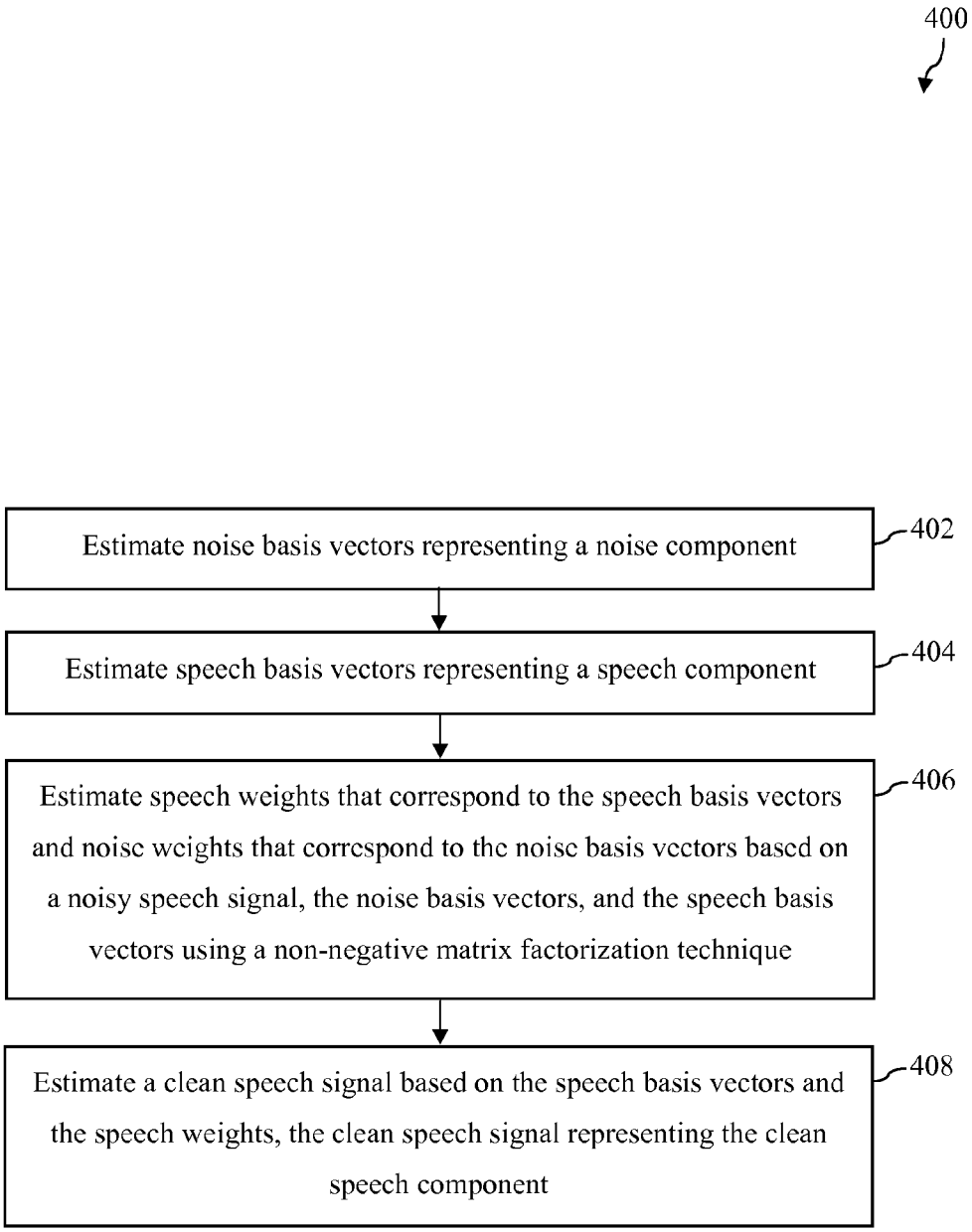
Figure 5:
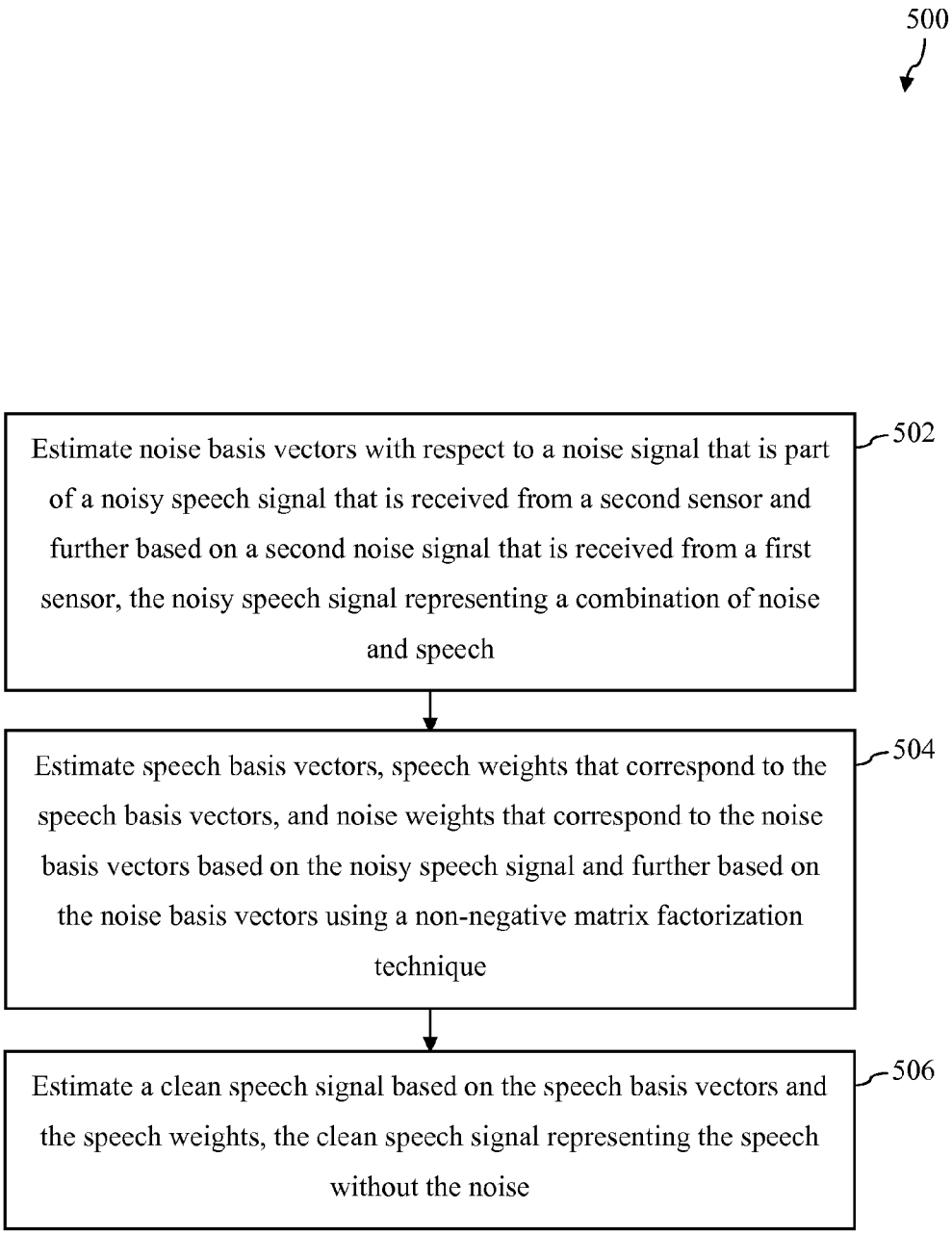
Figure 6:
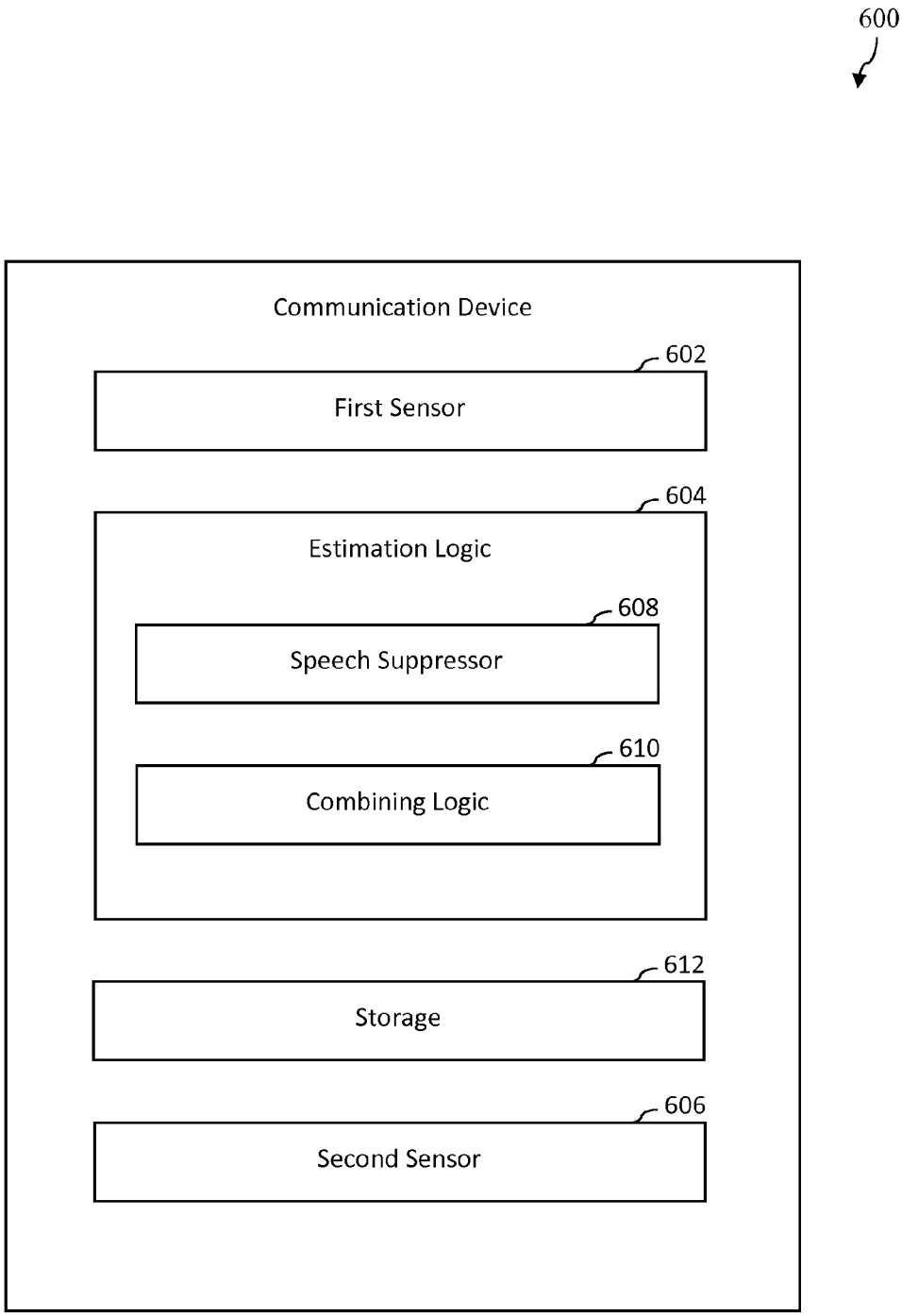
FIGS. 6-7 and 13-15 are block diagrams of example implementations of a communication device shown in FIG. 1 in accordance with embodiments described herein.

FIGS. 3-5 depict flowcharts 300, 400, and 500 of example methods for reducing noise in accordance with embodiments described herein. Flowcharts 300, 400, and 500 may be performed by communication device 100 shown in FIG. 1, for example. For illustrative purposes, flowcharts 300, 400, and 500 are described with respect to a communication device 600 shown in FIG. 6, which is an example of a communication device 100, according to an embodiment. As shown in FIG. 6, communication device 600 includes a first sensor 602, estimation logic 604, and second sensor 606. Estimation logic 604 includes speech suppressor 608, combining logic 610, and storage 612. Further structural and operational embodiments will be apparent to persons skilled in the relevant art(s) based on the discussion regarding flowcharts 300, 400, and 500.

As shown in FIG. 3, the method of flowchart 300 begins at step 302. In step 302, at least noise basis vectors are estimated with respect to a noise signal that is received from a first sensor of a communication device that is configured to be distal a mouth of a user during operation of the communication device to provide a noise model that represents noise provided by audio sources other than the user. For example, the noise basis vectors may be estimated using a non-negative matrix factorization technique. Some example non-negative matrix factorization techniques are described in further detail below with reference to FIGS. 7 and 10. In another example, the noise basis vectors may be estimated using a clustering technique. For instance, a clustering technique known from vector quantization may be used. One example of such a clustering technique is known to persons skilled in the relevant art(s) as a K-means technique. In an example implementation, estimation logic 604 estimates noise basis vectors with respect to a noise signal that is received from first sensor 602.

In an example embodiment, a blocking matrix is applied to multiple signals that are received from respective sensors of the communication device to suppress indications of the speech therein. In accordance with this embodiment, the multiple signals include the noise signal and the noisy speech signal. As an example, a blocking matrix technique known from beamforming such as adaptive beamforming in the form of a Generalized Sidelobe Canceller (GSC) may be used. In an example implementation, speech suppressor 608 applies the blocking matrix to the multiple signals. For instance, speech suppressor 608 may be coupled between second sensor 606 and other functional components of estimation logic 604.

At step 304, speech basis vectors, speech weights that correspond to the speech basis vectors, and noise weights that correspond to the noise basis vectors are estimated based on the noise basis vectors and a noisy speech signal that is received from a second sensor of the communication device that is configured to be proximate the mouth of the user during the operation of the communication device using a non-negative matrix factorization technique. The noisy speech signal represents a combination of speech and the noise. In an example implementation, estimation logic 604 estimates the speech basis vectors, the speech weights, and the noise weights based on a noisy speech signal that is received from second sensor 606.

At step 306, a clean speech signal is estimated based on the speech basis vectors and the speech weights. The clean speech signal represents the speech without the noise. In an example implementation, estimation logic 604 estimates the clean speech signal.

In an example embodiment, the noise basis vectors are estimated at step 302 with regard to successive time instances on-line to provide respective estimates of the noise basis vectors. In accordance with this embodiment, the speech basis vectors, the speech weights, and the noise weights are estimated at step 304 with regard to the successive time instances on-line based on the noise basis vectors to provide respective estimates of the speech basis vectors, respective estimates of the speech weights, and respective estimates of the noise weights. It will be recognized that the noise basis vectors may be fixed or updated at a different rate than the speech basis vectors, the speech weights, and/or the noise weights. In further accordance with this embodiment, successive portions of the clean speech signal that correspond to the respective time instances are estimated at step 306 based on the respective estimates of the speech weights. The successive portions of the clean speech signal may be estimated further based on the respective estimates of the speech basis vectors and the respective estimates of the speech basis vectors and the respective estimates of the noise basis vectors.

In an aspect of the aforementioned embodiment, the noise basis vectors are estimated at step 302 on-line based on current and past samples of the noise signal with regard to each of the successive time instances to provide the respective estimates of the noise basis vectors. In accordance with this aspect, the speech basis vectors, the speech weights, and the noise weights are estimated at step 304 on-line based on current and past samples of the noisy speech signal at each of the successive time instances.

In a further aspect of the aforementioned embodiment, estimating the successive portions of the clean speech signal includes estimating current samples of the clean speech signal. In accordance with this aspect, a subset of the speech weights that corresponds to the current samples of the noisy speech signal is identified. In further accordance with this aspect, the clean speech signal is estimated based on the speech basis vectors and the subset of the speech weights.

In another example embodiment, the speech basis vectors are estimated at step 304 off-line to provide respective estimates of the speech basis vectors. In accordance with this embodiment, the estimates of the speech basis vectors are stored to be used on-line for estimating a subsequent clean speech signal. For instance, the estimates may be stored to be used on-line for estimating the subsequent clean speech signal during a subsequent operation of the communication device. In an example implementation, storage 612 stores the estimates of the speech basis vectors.

In some example embodiments, one or more steps 302, 304, and/or 306 of flowchart 300 may not be performed. Moreover, steps in addition to or in lieu of steps 302, 304, and/or 306 may be performed.

As shown in FIG. 4, the method of flowchart 400 begins at step 402. In step 402, noise basis vectors that represent a noise component are estimated. In an example implementation, estimation logic 604 estimates the noise basis vectors.

At step 404, speech basis vectors that represent a clean speech component are estimated. In an example implementation, estimation logic 604 estimates the speech basis vectors.

In an example embodiment, the noise component and the clean speech component are included in a common signal. In another example embodiment, the noise component is included in a first signal, and the clean speech component is included in a second signal that is different from the first signal. For instance, the first signal may be received from a first sensor, and the second signal may be received from a second sensor that is different from the first sensor.

At step 406, speech weights that correspond to the speech basis vectors and noise weights that correspond to the noise basis vectors are estimated based on a noisy speech signal, the noise basis vectors, and the speech basis vectors using a non-negative matrix factorization technique. In an example implementation, estimation logic 604 estimates the speech weights and the noise weights.

At step 408, a clean speech signal is estimated based on the speech basis vectors and the speech weights. The clean speech signal represents the clean speech component. In an example implementation, estimation logic 604 estimates the clean speech signal.

In an example embodiment, a speech suppression technique may be performed with respect to multiple signals to suppress indications of speech therein to provide at least one speech-suppressed noise signal. The noise component may be determined based on the at least one speech-suppressed noise signal.

In another example embodiment, indications of speech may be enhanced by combining multiple signals from respective sensors. In an example implementation, combining logic 610 combines the multiple signals from the respective sensors.

In yet another example embodiment, the noise basis vectors are estimated at step 402 on-line based on current and past samples of a noise signal that includes the noise component with regard to each of the successive time instances to provide respective estimates of the noise basis vectors. In accordance with this embodiment, the speech basis vectors are estimated at step 404 on-line based on current and past samples of the noisy speech signal at each of the successive time instances to provide respective estimates of the speech basis vectors. In further accordance with this embodiment, the speech weights and the noise weights are estimated at step 406 on-line based on the current and past samples of the noisy speech signal, the respective estimates of the noise basis vectors, and the respective estimates of the speech basis vectors. In still further accordance with this embodiment, estimating the clean speech signal at step 408 includes identifying a subset of the speech weights that corresponds to the current samples of the noisy speech signal, and estimating the clean speech signal based on the respective estimates of the speech basis vectors and respective subsets of the speech weights that correspond to respective current samples of the noisy speech signal.

In still another example embodiment, estimating the noise basis vectors at step 402 includes calculating spectra of a noise signal that includes the noise component. In accordance with this embodiment, estimating the noise basis vectors further includes approximating the spectra of the noise signal based on the noise basis vectors multiplied by the noise weights. In further accordance with this embodiment, estimating the speech basis vectors at step 404 includes calculating spectra of the noisy speech signal. In still further accordance with this embodiment, estimating the speech basis vectors further includes approximating the spectra of the noisy speech signal based on a combination (e.g., concatenation) of the estimated noise basis vectors and the speech basis vectors multiplied by a combination (e.g., concatenation) of the noise weights and the speech weights. The spectra of the noise signal and the spectra of the noisy speech signal may be any suitable type of spectra, including but not limited to amplitude modulation spectra, magnitude spectra, power spectra, etc.

In some example embodiments, one or more steps 402, 404, 406, and/or 408 of flowchart 400 may not be performed. Moreover, steps in addition to or in lieu of steps 402, 404, 406, and/or 408 may be performed.

As shown in FIG. 5, the method of flowchart 500 begins at step 502. In step 502, noise basis vectors are estimated based on a noise signal that is part of a noisy speech signal that is received from a second sensor and further based on a second noise signal that is received from a first sensor. The noisy speech signal represents a combination of noise and speech. In an example, estimating the noise basis vectors may include applying a blocking matrix to multiple signals that are received from respective sensors of a communication device to suppress indications of the speech therein to obtain an estimate of the noise signal, though the scope of the embodiments is not limited in this respect. In accordance with the aforementioned example, the multiple signals may include the noisy speech signal. In an example implementation, estimation logic 604 estimates the noise basis vectors.

At step 504, speech basis vectors, speech weights that correspond to the speech basis vectors, and noise weights that correspond to the noise basis vectors are estimated based on the noisy speech signal and further based on the noise basis vectors using a non-negative matrix factorization technique. In an example implementation, estimation logic 604 estimates speech basis vectors, the speech weights, and the noise weights.

At step 506, a clean speech signal is estimated based on the speech basis vectors and the speech weights. The clean speech signal represents the speech without the noise. In an example implementation, estimation logic 604 estimates the clean speech signal.

In some example embodiments, one or more steps 502, 504, and/or 506 of flowchart 500 may not be performed. Moreover, steps in addition to or in lieu of steps 502, 504, and/or 506 may be performed.

It will be recognized that communication device 600 may not include one or more of first sensor 602, estimation logic 604, second sensor 606, speech suppressor 608, combining logic 610, and/or storage 612. Furthermore, communication device 600 may include modules in addition to or in lieu of first sensor 602, estimation logic 604, second sensor 606, speech suppressor 608, combining logic 610, and/or storage 612.

Figure 7:
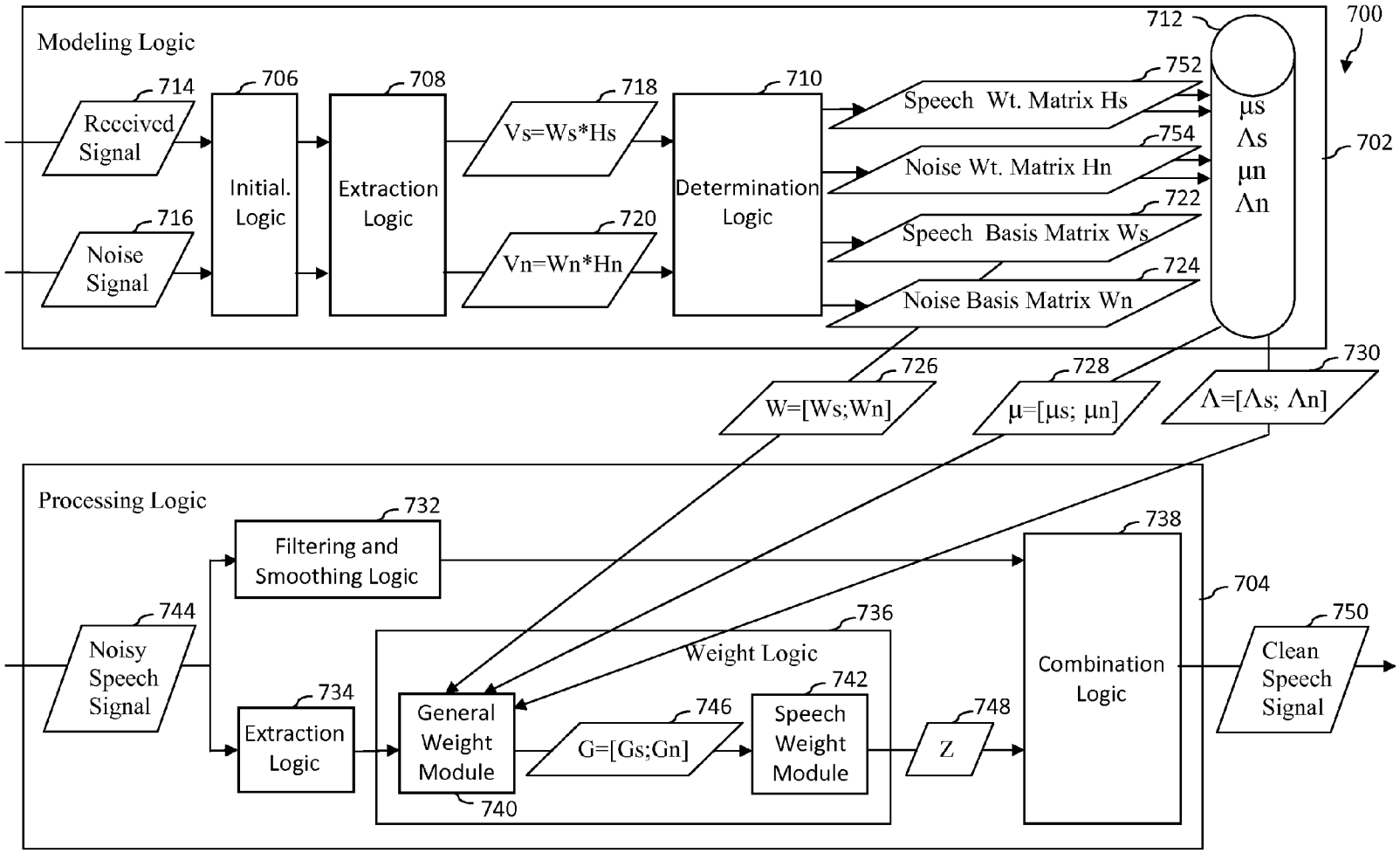

FIG. 7 is a block diagram of an example communication device 700 in accordance with an embodiment described herein. As shown in FIG. 7, communication device 700 includes modeling logic 702 and processing logic 704. Generally speaking, modeling logic 702 is operable to generate a speech basis matrix 722 and a speech weighting matrix 752 based on a received signal 714. Modeling logic 702 is further operable to generate a noise basis matrix 724 and a noise weighting matrix 754 based on a noise signal 716. Modeling logic 702 includes initialization logic 706, extraction logic 708, determination logic 710, and store 712. Initialization logic 706 performs initialization operations with respect to received signal 714 and noise signal 716 so that features may be extracted therefrom. Examples of initialization operations include but are not limited to frequency mapping, frequency conversion, filter generation, etc. One example initialization technique is described below with reference to FIG. 8.

Extraction logic 708 extracts a speech feature 718, which is represented as Vs=Ws*Hs, from the received signal 714. Ws, labeled as element 722, is a speech basis matrix that includes multiple speech basis vectors. Hs, labeled as element 752, is a speech weighting matrix that includes multiple speech weight vectors that represent the time-varying activation levels of the speech basis matrixs Ws. Each set of the speech basis vectors and each of the speech weight vectors correspond to a respective frequency sub-band of the received signal 714. Extraction logic 708 extracts a noise feature 720, which is represented as Vn=Wn*Hn, from the noise signal 716. Wn, labeled as element 724, is a noise basis matrix that includes multiple noise basis vectors. Hn, labeled as element 754, is a noise weighting matrix that includes multiple noise weight vectors that represent the time-varying activation levels of the basis matrix Wn. Each set of the noise basis vectors and each of the noise weight vectors correspond to a respective frequency sub-band of the noise signal 716. One example extraction technique is described below with reference to FIG. 9.

Determination logic 710 determines Ws and Hs in accordance with a non-negative matrix factorization technique. Determination logic 710 generates the speech basis matrix Ws 722 and speech weighting matrix Hs 752. The speech weighting matrix Hs 752 further generates μs and Λs. Determination logic 710 determines Wn and Hn in accordance with a non-negative matrix factorization technique, which may be the same as or different from the non-negative matrix factorization technique in accordance with which determination logic 710 determines Ws and Hs. Determination logic 710 generates the noise basis matrix Wn 724 and weighting matrix Hn 754. The noise weighting matrix Hn 754 further generates μn and Λn. Speech basis matrix Ws 722 and noise basis matrix Wn 724 provide a cumulative basis matrix 726, which is represented as W, the estimated statistics of the speech coefficients μs and Λs and the estimated statistics of the noise coefficients μn and Λn are concatenated to form μ, labeled as element 728, and Λ, labeled as element 730. For example, μ=[μs:μn], and Λ=[Λs:Λn]. In accordance with this example, μ, may be a vector, and Λ may be a matrix. W 726, μ 728, and Λ 730 are passed to processing logic 704 for further processing. One example model generation technique is described below with reference to FIG. 10.

In accordance with an example embodiment, standard NMF techniques are performed separately with respect to received signal 714 and noise signal 716. For example, a first NMF operation may be performed with respect to received signal 714 while maintaining a relatively low value of (e.g., minimizing) D(Vs||WsHs). In accordance with this example, a second NMF operation may be performed with respect to noise signal 716 while maintaining a relatively low value of (e.g., minimizing) D(Vn||WnHn).

Store 712 stores the speech coefficients μs and Λs and the noise coefficients μn and Λn that represent the statistics of the speech weighting matrix Hs 752 and the noise weighting matrix Hn 754, respectively.

Generally speaking, processing logic 704 is operable to process a noisy speech signal 744 based on W, the speech coefficients μs and Λs, and the noise coefficients μn and Λn to provide a clean speech signal 750. Processing logic 704 includes filtering and smoothing logic 732, extraction logic 734, weight logic 736, and combination logic 738. Filtering and smoothing logic 732 sub-band filters the noisy speech signal 744 to provide samples for the respective sub-bands of the noisy speech signal 744. Filtering and smoothing logic 732 smoothes the samples to provide smoothed samples of the noisy speech signal 744.

Extraction logic 734 extracts a feature represented as Vm=W*G from the noisy speech signal 744.

Weight logic 736 includes general weight module 740 and speech weight module 742. General weight module 740 analyzes Vm to determine G based on W, μ, and Λ in accordance with a non-negative matrix factorization technique based on an objective function. For instance, general weight module 740 may receive W in cumulative basis matrix 726 from determination logic 710. General weight module 740 may retrieve a first cumulative coefficient matrix 728, which is represented as μ and which includes μs and μn, from store 712. General weight module 740 may retrieve a second cumulative coefficient matrix 730, which is represented as Λ and which includes Λs and Λn, from store 712. General weight module 740 generates an estimated weight matrix 746, which is represented as G and which includes Gs and Gn, based on the feature Vm=W*G that is extracted by extraction logic 734, the cumulative basis matrix 726, the first cumulative coefficient matrix 728, and the second cumulative coefficient matrix 730. General weight module 740 provides the estimated weight matrix 746 to speech weight module 742 for processing.

Speech weight module 742 analyzes G to determine an optimal weighting matrix 748 to be applied to the smoothed samples of the noisy speech signal 744 that are provided by filtering and smoothing logic 732. The optimal weighting matrix 748 is represented as Z and includes optimal weighting vectors that correspond to the respective sub-bands of the noisy speech signal 744.

The operations performed by extraction logic 734 and weight logic 736 may be referred to as speech separation operations. One example speech separation technique is described below with reference to FIG. 11.

Combination logic 738 combines the optimal weighting vectors and the respective smoothed samples of the noisy speech signal 744 to provide respective weighted samples. For instance, combination logic 738 may multiply the optimal weighting vectors and the respective smoothed samples to provide the respective weighted samples. Combination logic 738 combines the weighted samples to provide the clean speech signal 750. For instance, combination logic 738 may sum the weighted samples to provide the clean speech signal 750.

The operations performed by filtering and smoothing logic 732 and combination logic 738 may be referred to as speech reconstruction operations. One example speech reconstruction technique is described below with reference to FIG. 12.

It will be recognized that estimation logic 604 of FIG. 6 may be implemented partially or entirely in modeling logic 702. It will be further recognized that estimation logic 604 may be implemented partially or entirely in processing logic 704. For instance, a first portion of estimation logic 604 may be implemented in modeling logic 702, and a second portion of estimation logic 604 may be implemented in processing logic 704.

Figure 8:
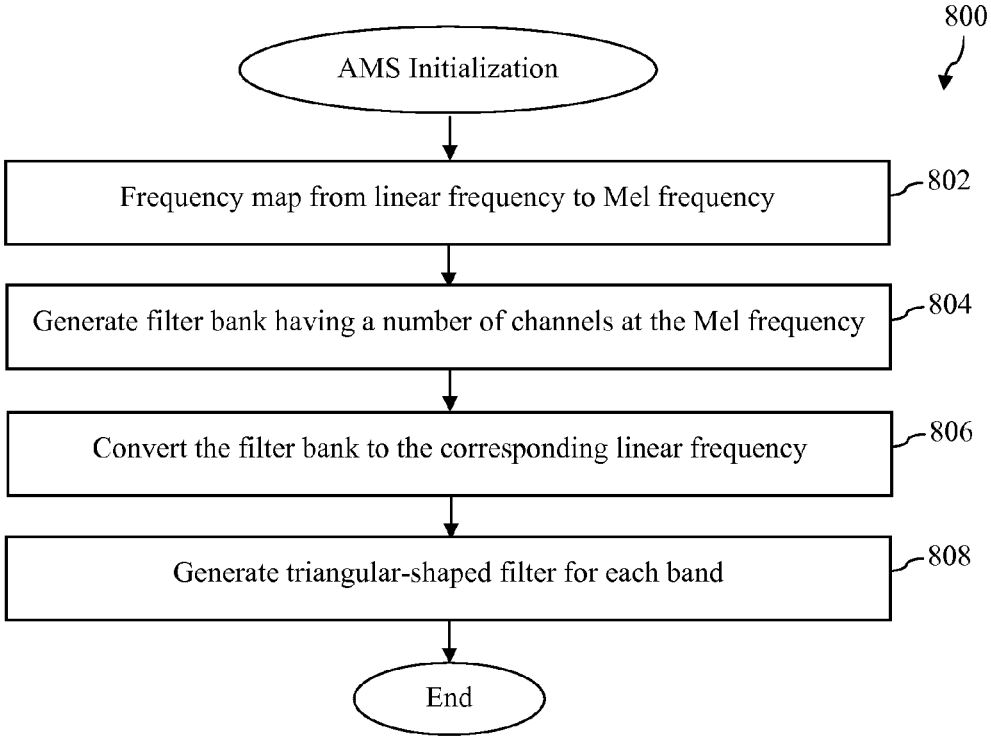
FIG. 8 depicts a flowchart of an example method for performing amplitude modulation spectrum (AMS) initialization in accordance an embodiment described herein.

FIG. 8 depicts a flowchart 800 of an example method for performing amplitude modulation spectrum (AMS) initialization in accordance an embodiment described herein. For instance, each of received signal 714 and noise signal 716 of FIG. 7 may be initialized in accordance with the method described in flowchart 800. The initialization method depicted in flowchart 800 is described as employing an AMS technique for illustrative purposes and is not intended to be limiting. It will be recognized that signals, such as received signal 714 and noise signal 716, may be represented using any suitable type of features, including but not limited to AMS, magnitude, power, etc. Flowchart 800 may be performed by initialization logic 706 shown in FIG. 7, though the scope of the embodiments is not limited in this respect.

As shown in FIG. 8, the method of flowchart 800 starts at step 802. In step 802, frequency mapping is performed from a linear frequency to a Mel frequency. For instance, received signal 714 and/or noise signal 716 may be converted from a linear frequency domain representation to a Mel frequency domain representation.

At step 804, a filter bank having a number of channels is generated at the Mel frequency. For instance, the channels may be generated uniformly. The number of channels may be any suitable number.

At step 806, the filter bank is converted to the corresponding linear frequency. For instance, the filter bank may be converted from a Mel domain representation to a linear frequency domain representation.

At step 808, triangular-shaped filters are generated for the respective bands of the filter bank. For instance, the triangular filters may be generated in the linear frequency domain. Upon completion of step 808, flowchart 808 ends.

In some example embodiments, one or more steps 802, 804, 806, and/or 808 of flowchart 800 may not be performed. Moreover, steps in addition to or in lieu of steps 802, 804, 806, and/or 808 may be performed.

Figure 9:
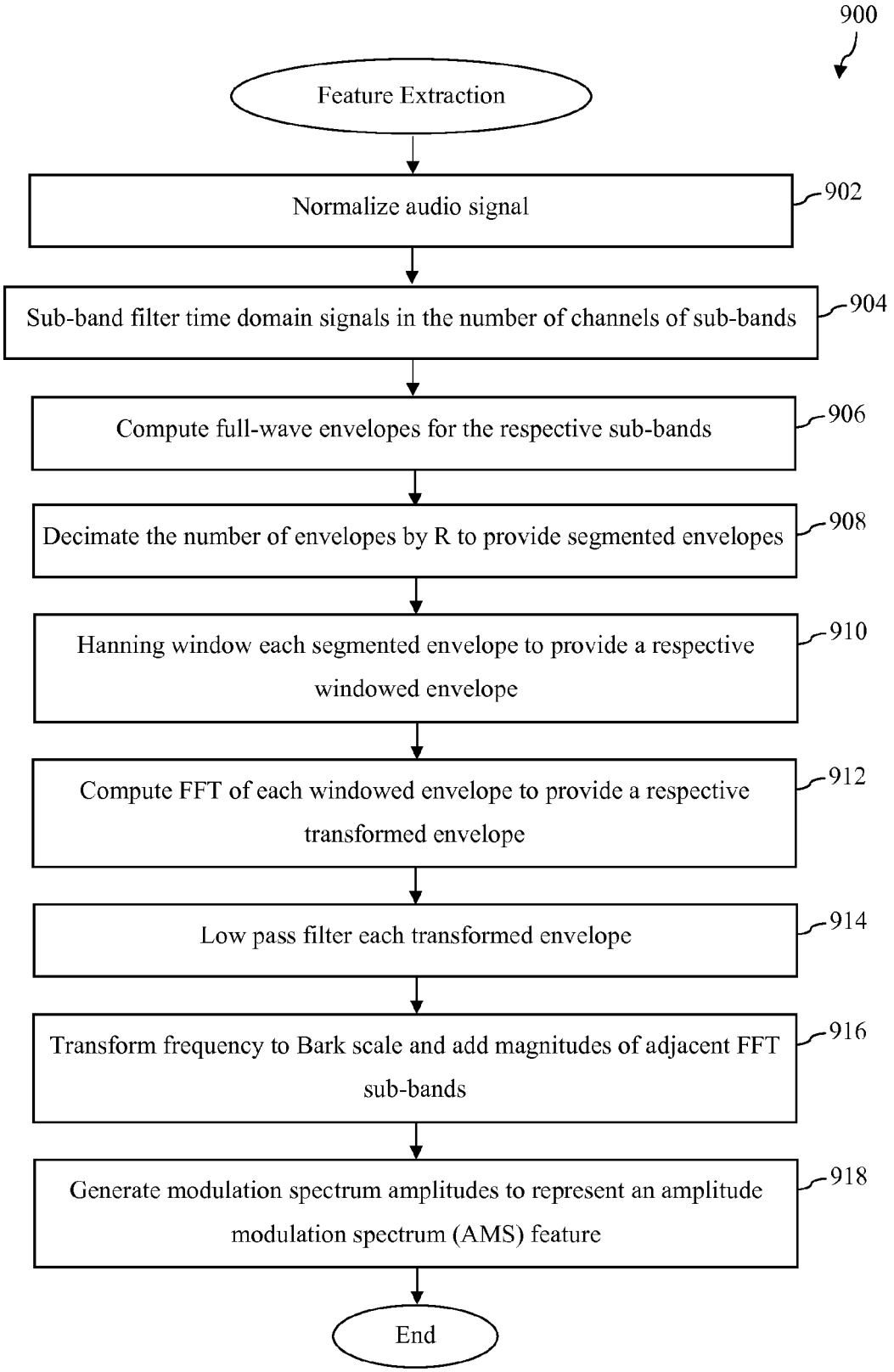
FIG. 9 depicts a flowchart of an example method for performing feature extraction in accordance an embodiment described herein.

FIG. 9 depicts a flowchart 900 of an example method for performing feature extraction in accordance an embodiment described herein. For instance, a feature may be extracted from each of received signal 714 and noise signal 716 of FIG. 7 in accordance with the method described in flowchart 900. Flowchart 900 may be performed by extraction logic 708 shown in FIG. 7, though the scope of the embodiments is not limited in this respect.

As shown in FIG. 9, the method of flowchart 900 starts at step 902. In step 902, an audio signal is normalized. For instance, the audio signal may be normalized to a reference amplitude (e.g., −26 dBov).

At step 904, time domain signals are sub-band filtered (e.g., Mel scaled) in the number of channels of sub-bands. For instance, the time domain signals may be separated into overlapping sub-bands, such that each sub-band overlaps at least its neighboring sub-bands.

At step 906, full-wave envelopes are computed for the respective sub-bands.

At step 908, the number of envelopes is decimated by R to provide segmented envelopes. As will be recognized by persons skilled in the relevant art(s), the term "decimate" means to utilize every Rth envelope. Accordingly, if R=3, every third envelope may be used, and the other envelopes may be discarded.

At step 910, a Hanning window is applied to each segmented envelope to provide a respective windowed envelope.

At step 912, a fast Fourier transform (FFT) may be performed with respect to each windowed envelope to provide a respective transformed envelope.

At step 914, each transformed envelope is low pass filtered. A modulation frequency of each transformed envelope may be limited to a specified range of frequencies (e.g., a range of 50-400 Hertz).

At step 916, each frequency is transformed to Bark scale, and magnitudes of adjacent FFT sub-bands are added. The Bark scale reflects the human auditory system. In general, the Bark scale is more sensitive to relatively lower frequencies and less sensitive to relatively higher frequencies. Accordingly, frequency resolution for the relatively lower frequencies may be greater than the frequency resolution for the relatively higher frequencies.

At step 918, modulation spectrum amplitudes are generated to represent an amplitude modulation spectrum (AMS). The AMS may have any suitable number of dimensions (e.g., 10, 15, 32, etc.).

In some example embodiments, one or more steps 902, 904, 906, 908, 910, 912, 914, 916, and/or 918 of flowchart 900 may not be performed. Moreover, steps in addition to or in lieu of steps 902, 904, 906, 908, 910, 912, 914, 916, and/or 918 may be performed.

Figure 10:
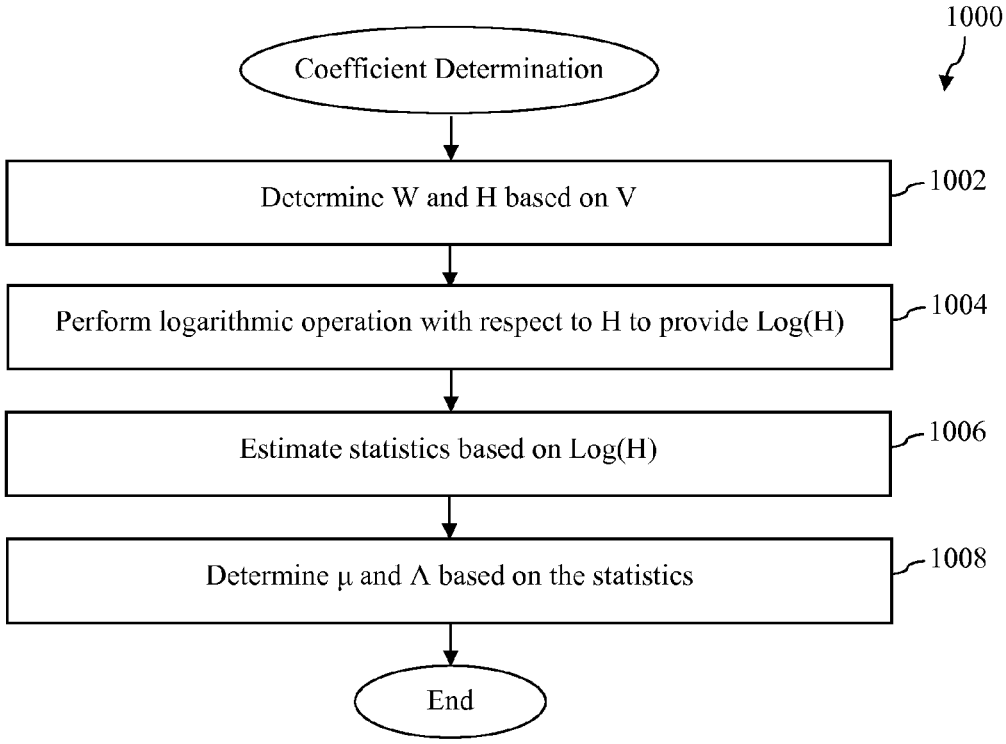
FIG. 10 depicts a flowchart of an example method for performing coefficient determination in accordance an embodiment described herein.

FIG. 10 depicts a flowchart 1000 of an example method for determining coefficients in accordance an embodiment described herein. For instance, coefficients may be determined with respect to each of received signal 714 and noise signal 716 of FIG. 7 in accordance with the method described in flowchart 1000. Flowchart 1000 may be performed by determination logic 710 shown in FIG. 7, though the scope of the embodiments is not limited in this respect.

As shown in FIG. 10, the method of flowchart 1000 starts at step 1002. In step 1002, W and H are determined based on V. For instance, W and H may be determined in accordance with the following equations:

$$D(V \parallel WH) = \sum_{ij} V_{ij} \log \frac{V_{ij}}{(WH)_{ij}} - V_{ij} + (WH)_{ij} \quad \text{(Equation 1)}$$

$$H'_{a\mu} = H_{a\mu} \frac{\sum_i W_{ia} V_{i\mu} / (WH)_{i\mu}}{\sum_k W_{ka}} \quad \text{(Equation 2)}$$

$$W'_{ia} = W_{ia} \frac{\sum_\mu H_{a\mu} V_{i\mu} / (WH)_{i\mu}}{\sum_v H_{av}} \quad \text{(Equation 3)}$$

In Equation 2, $H'_{a\mu}$ may be used to represent each of Hs and Hn. In Equation 3, $W'_{ia}$ may be used to represent each of Ws and Wn. Equations 1-3 define an NMF technique for illustrative purposes, though it will be recognized that other techniques in addition to or in lieu of the NMF technique may be used to determine the coefficients.

At step 1004, a logarithmic operation is performed with respect to H to provide Log(H).

At step 1006, the estimated statistics model is generated based on Log(H).

At step 1008, μ and Λ are determined based on the weighting vector that is generated at step 1006. μ and Λ represent the estimated statistics.

In some example embodiments, one or more steps 1002, 1004, 1006, and/or 1008 of flowchart 1000 may not be performed. Moreover, steps in addition to or in lieu of steps 1002, 1004, 1006, and/or 1008 may be performed.

Figure 11:
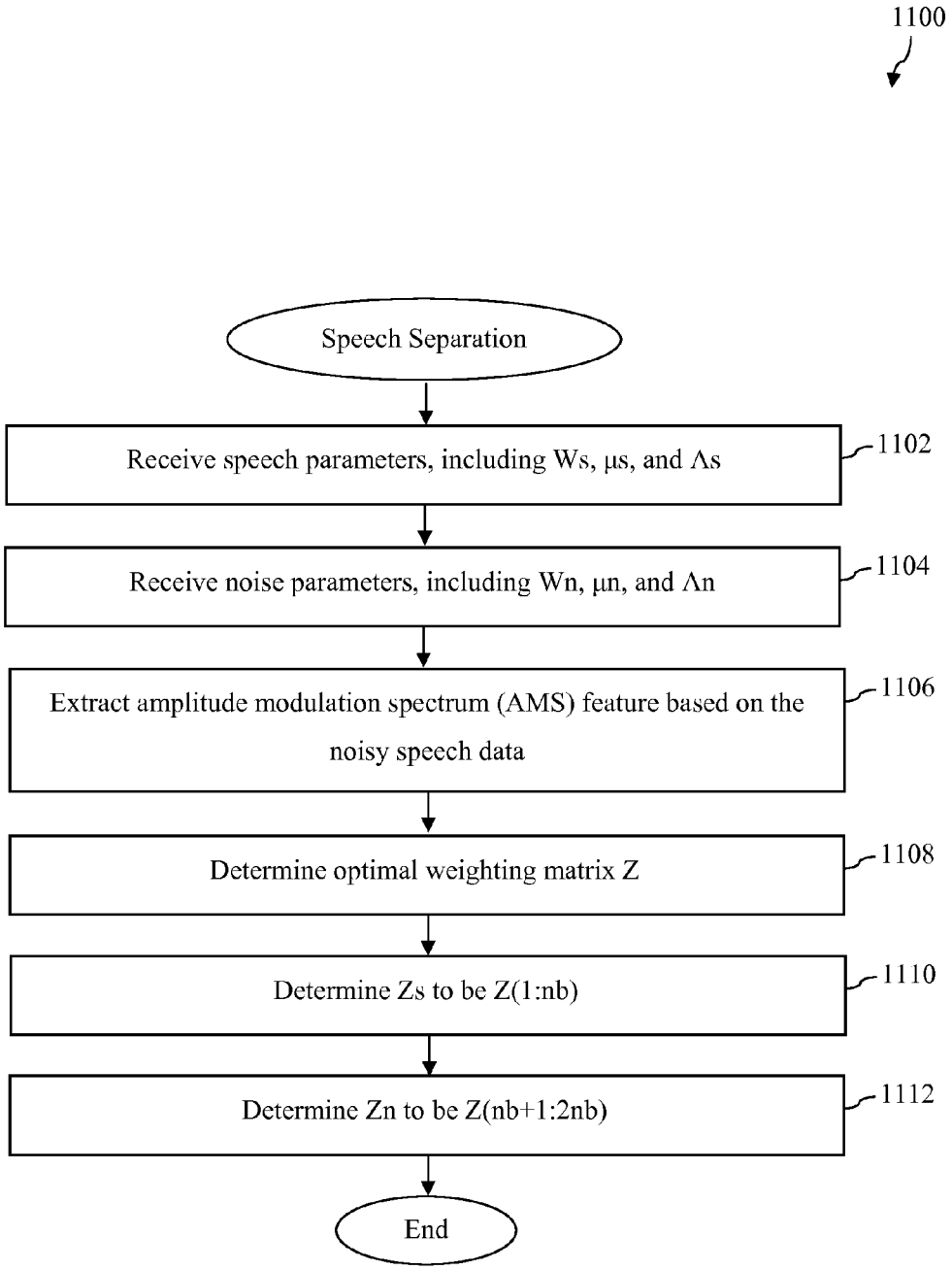
FIG. 11 depicts a flowchart of an example method for performing speech separation in accordance an embodiment described herein.

FIG. 11 depicts a flowchart 1100 of an example method for performing speech separation in accordance an embodiment described herein. Flowchart 1100 may be performed by extraction logic 734 and weight logic 736 shown in FIG. 7, though the scope of the embodiments is not limited in this respect.

As shown in FIG. 11, the method of flowchart 1100 starts at step 1102. In step 1102, speech parameters are received. The speech parameters include Ws, μs, and Λs.

At step 1104, noise parameters are received. The noise parameters include Wn, μn, and Λn.

At step 1106, an amplitude modulation spectrum (AMS) feature is extracted based on the noisy speech data. AMS is one example type of feature and is not intended to be limiting. Persons skilled in the relevant art(s) will recognize that any suitable type of feature may be extracted from the noisy speech data.

At step 1108, an optimal weighting matrix Z is determined. For instance, Z may be determined in accordance with the following equations:

$$D(V \,||\, WG) = \sum_{ij} V_{ij} \log \frac{V_{ij}}{(WG)_{ij}} - V_{ij} + (WG)_{ij} \quad \text{(Equation 4)}$$

$$G'_{ab} = G_{ab} \frac{\sum_i W_{ib} V_{ib} / (WG)_{ib}}{\left[\sum_k W_{ka} + \alpha \varphi_B(G)\right]_\varepsilon} \quad \text{(Equation 5)}$$

$$\varphi'_B(G_{ab}) = -\frac{(\Lambda_B^{-1}(\log G_{:,b} - \mu))_a}{G_{ab}} \quad \text{(Equation 6)}$$

In Equation 5, $G'_{ab}$ may be used to represent Z. Equations 4-6 define an NMF technique for illustrative purposes, though it will be recognized that other techniques in addition to or in lieu of the NMF technique may be used to perform the speech separation.

At step 1110, Zs is determined to be Z(1:nb). Z(1:nb) is the first nb rows of the optimal weighting matrix. For instance, if Z were to include 120 rows, Z(1:nb) would include the first 60 of those rows.

At step 1112, Zn is determined to be Z(nb+1:2nb). Z(nb+1:2nb) is the last nb rows of the optimal weighting vector. For instance, if Z were to include 120 rows, Z(nb+1:2nb) would include the last 60 of those rows.

In some example embodiments, one or more steps 1102, 1104, 1106, 1108, 1110, and/or 1112 of flowchart 1100 may not be performed. Moreover, steps in addition to or in lieu of steps 1102, 1104, 1106, 1108, 1110, and/or 1112 may be performed.

Figure 12:
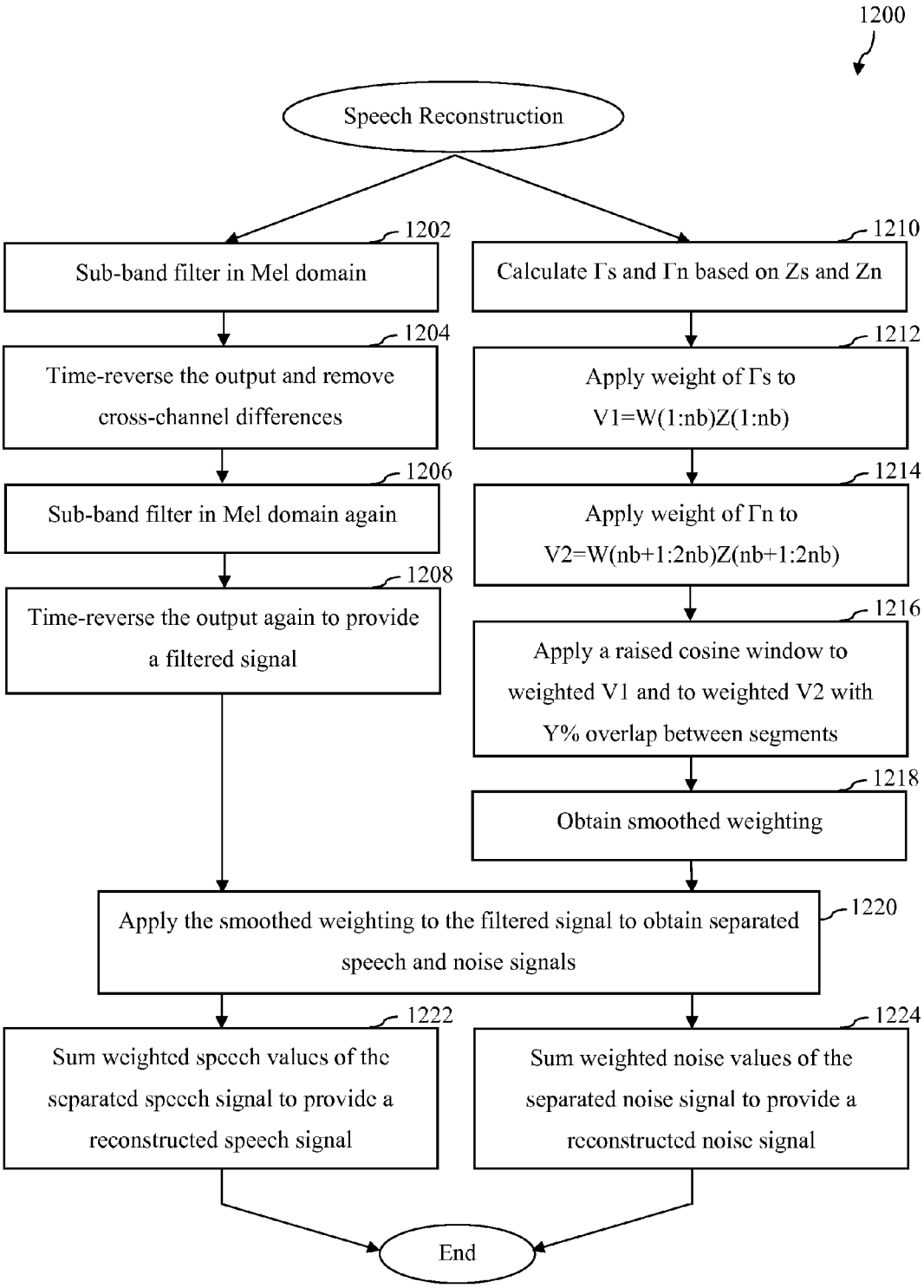
FIG. 12 depicts a flowchart of an example method for performing speech reconstruction in accordance an embodiment described herein.

FIG. 12 depicts a flowchart 1200 of an example method for performing speech reconstruction in accordance an embodiment described herein. Flowchart 1200 may be performed by filtering and smoothing logic 732 and combination logic 738 shown in FIG. 7, though the scope of the embodiments is not limited in this respect.

As shown in FIG. 12, the method of flowchart 1200 starts at step 1202. In step 1202, sub-band filtering is performed in the Mel domain. For instance, the sub-band filtering may be performed with respect to noisy speech signal 744.

At step 1204, the output of step 1202 is time-reversed, and cross-channel differences are removed from the output.

At step 1206, sub-band filtering is performed in the Mel domain again. For instance, the sub-band filtering may be performed with respect to the output upon completion of step 1204.

At step 1208, the output is time-reversed again to provide a filtered signal. Upon completion of step 1208, flow continues to step 1220.

At step 1210, Γs and Γn are determined based on Zs and Zn. For instance, Γs and Γn may be determined in accordance with the following equations:

$$\Gamma s = V1/(V1+V2) \quad \text{(Equation 7)}$$

$$\Gamma n = V2/(V1+V2) \quad \text{(Equation 8)}$$

$$V1 = W(1{:}nb)Z(1{:}nb) \quad \text{(Equation 9)}$$

$$V2 = W(nb{+}1{:}2nb)Z(nb{+}1{:}2nb) \quad \text{(Equation 10)}$$

It will be recognized that Zs=Z(1:nb) and Zn=Z(nb=1:2nb).

At step 1212, a weight of Γs is applied to V1.

At step 1214, a weight of Γn is applied to V2.

At step 1216, a raised cosine window is applied to weighted V1 and to weighted V2 with Y % overlap between segments. Y % may be any suitable percentage (e.g., 17%, 25%, 50%, 60%, etc.).

At step 1218, a smoothed weighting is obtained based on V1 and V2. Upon completion of step 1218, flow continues to step 1220.

At step 1220, the smoothed weighting is applied to the filtered signal provided at step 1208 to obtain separated speech and noise signals. The separated speech signal includes weighted speech values that correspond to the respective sub-band filters. The separated noise signal includes weighted noise values that correspond to the respective sub-band filters.

At step 1222, the weighted speech values are summed to provide a reconstructed speech signal.

At step 1224, the weighted noise values are summed to provide a reconstructed noise signal.

In some example embodiments, one or more steps 1202, 1204, 1206, 1208, 1210, 1212, 1214, 1216, 1218, 1220, 1222, and/or 1224 of flowchart 1200 may not be performed. Moreover, steps in addition to or in lieu of steps 1202, 1204, 1206, 1208, 1210, 1212, 1214, 1216, 1218, 1220, 1222, and/or 1224 may be performed.

Figure 13:
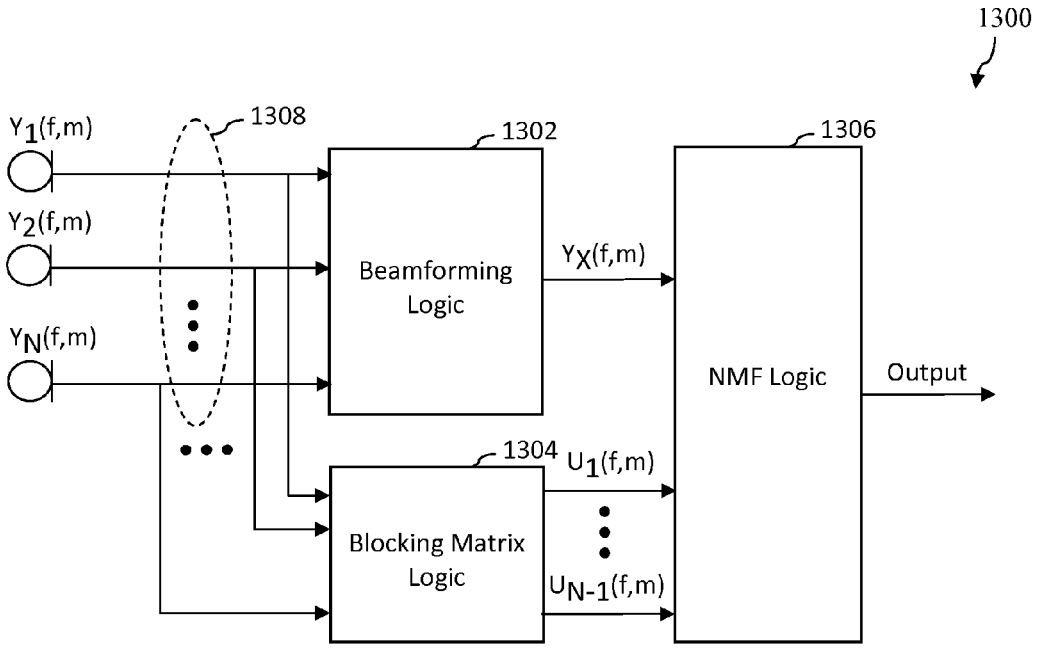

FIG. 13 is a block diagram of an example communication device 1300 in accordance with an embodiment described herein. As shown in FIG. 13, communication device 1300 includes beamforming logic 1302, blocking matrix logic 1304, and non-negative matrix factorization (NMF) logic 1306. Beamforming logic 1302 enhances targeted speech (e.g., a speech signal of a user) that is received from a specified direction with respect to other audio (e.g., background noise) from directions other than the specified direction. As shown in FIG. 13, beamforming logic 1302 receives a plurality of signals 1308, which are labeled $Y_1(f,m)$ through $Y_N(f,m)$. N can be any suitable positive integer that is greater than one. For instance, N may be equal to 2, 3, 4, 5, etc. One signal is described as being received from the specified direction for purposes of discussion and is not intended to be limiting. It will be recognized that any suitable number of the plurality of signals 1308 may be received from the specified direction. Beamforming logic 1302 may provide $Y_X(f,m)$ in accordance with any suitable beamforming technique, including but not limited to a fixed beamforming technique, an adaptive beamforming technique, a switched adaptive beamforming technique, etc.

Blocking matrix logic 1304 filters the targeted speech from the plurality of signals 1308 to provide noise-only estimations $U_1(f,m)$ through $U_{N-1}(f,m)$. It will be recognized that if N=2, blocking matrix logic 1304 will provide a single noise-only estimate, $U_1(f,m)$. It will be recognized that if N>2, blocking matrix logic 1304 may provide $U_1(f,m)$ through $U_{N-1}(f,m)$ as multiple noise estimates, or combined linearly as one or more (e.g., a single) noise-only estimate(s). The filtering that is performed by blocking matrix logic 1304 may be fixed or adaptive.

NMF logic 1306 performs a non-negative matrix factorization operation with respect to $Y_X(f,m)$ and $U_1(f,m)$ through $U_{N-1}(f,m)$ to provide an output. For instance, the output may define speech basis vectors and speech weighting vectors, and/or noise basis vectors and noise weighting vectors.

Figure 14:
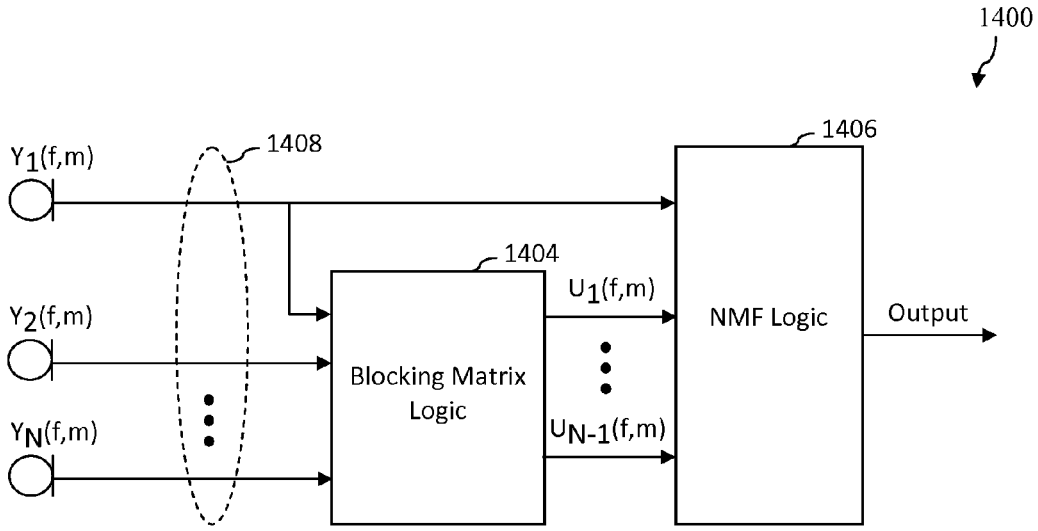

FIG. 14 is a block diagram of another example communication device 1400 in accordance with an embodiment described herein. As shown in FIG. 14, communication device 1400 includes blocking matrix logic 1404 and non-negative matrix factorization (NMF) logic 1406. Blocking matrix logic 1404 and NMF logic 1406 operate similarly to blocking matrix logic 1304 and NMF logic 1306, respectively, which are described above with reference to FIG. 13. However, communication device 1400 does not include beamforming logic. Accordingly, NMF logic 1406 performs a non-negative matrix factorization operation with respect to $Y_1(f,m)$ and $U_1(f,m)$ through $U_{N-1}(f,m)$ to provide an output. As mentioned above with reference to FIG. 13, the output may define speech basis vectors and speech weighting vectors, and/or noise basis vectors and noise weighting vectors.

Figure 15:
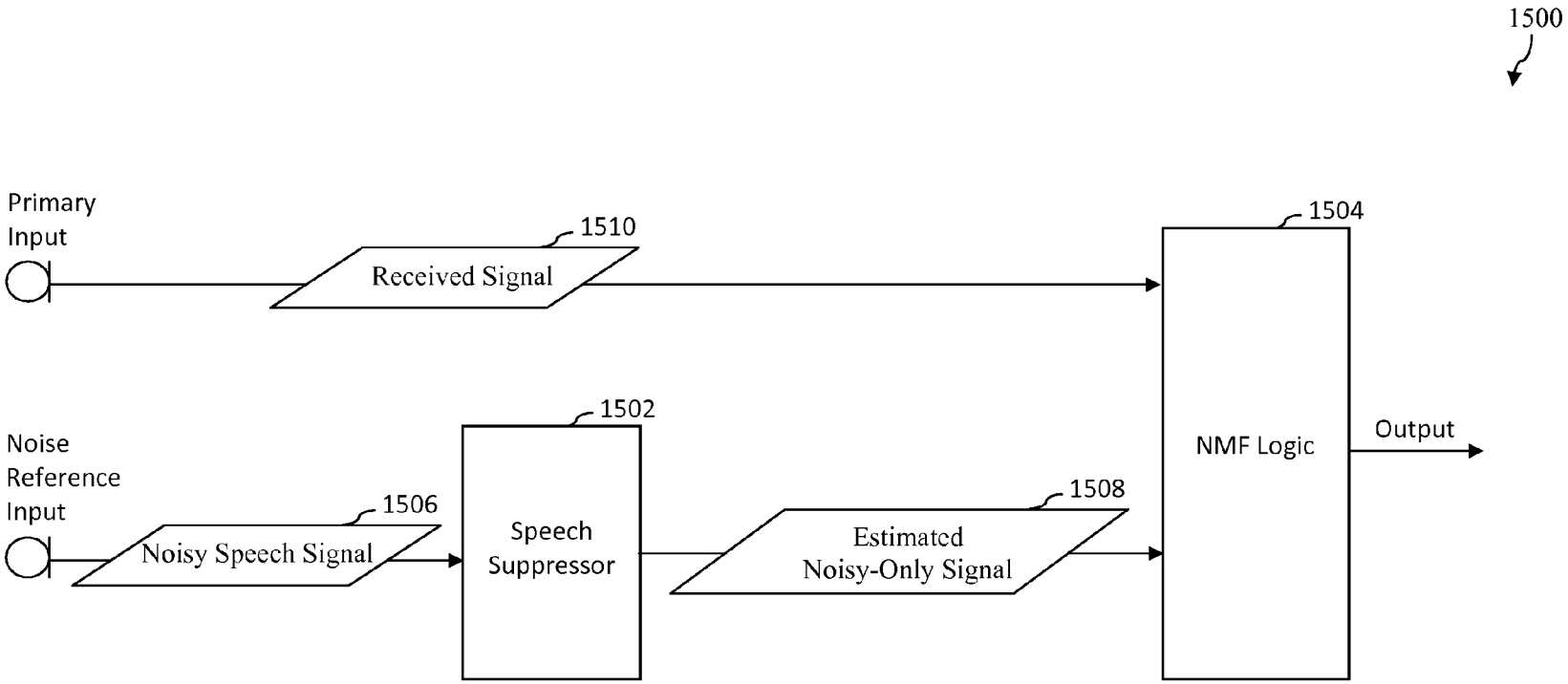

FIG. 15 is a block diagram of another example communication device 1500 in accordance with an embodiment described herein. As shown in FIG. 15, communication device 1500 includes a speech suppressor 1502 and NMF logic 1504. Speech suppressor 1502 is configured to extract a speech component from a noisy speech signal 1506. Speech suppressor 1502 is further configured to subtract the speech component from the noisy speech signal 1506 to provide an estimated noisy-only signal 1508. For instance, the estimated noise-only signal 1508 may be used by NMF logic 1504 as a speech-free noise estimates for noise cancellation in a received signal 1510.

Any one or more of estimation logic 604, speech suppressor 608, and/or combining logic 610 depicted in FIG. 6; modeling logic 702, processing logic 704, initialization logic 706, extraction logic 708, determination logic 710, filtering and smoothing logic 732, extraction logic 734, weight logic 736, combination logic 738, general weight module 740, and/or speech weight module 742 depicted in FIG. 7; beamforming logic 1302, block matrix logic 1304, and/or NMF logic 1306 depicted in FIG. 13; block matrix logic 1404 and/or NMF logic 1406 depicted in FIG. 14; and/or speech suppressor 1502 and/or NMF logic 1504 depicted in FIG. 15 may be included in processor 104 of FIG. 1.

It will be recognized that estimation logic 604, speech suppressor 608, and combining logic 610 depicted in FIG. 6; modeling logic 702, processing logic 704, initialization logic 706, extraction logic 708, determination logic 710, filtering and smoothing logic 732, extraction logic 734, weight logic 736, combination logic 738, general weight module 740, and speech weight module 742 depicted in FIG. 7; beamforming logic 1302, block matrix logic 1304, and NMF logic 1306 depicted in FIG. 13; block matrix logic 1404 and NMF logic 1406 depicted in FIG. 14; and speech suppressor 1502 and NMF logic 1504 depicted in FIG. 15 may be implemented in hardware, software, firmware, or any combination thereof.

For example, estimation logic 604, speech suppressor 608, combining logic 610, modeling logic 702, processing logic 704, initialization logic 706, extraction logic 708, determination logic 710, filtering and smoothing logic 732, extraction logic 734, weight logic 736, combination logic 738, general weight module 740, speech weight module 742, beamforming logic 1302, block matrix logic 1304, NMF logic 1306, block matrix logic 1404, NMF logic 1406, speech suppressor 1502, and/or NMF logic 1504 may be implemented as computer program code configured to be executed in one or more processors.

In another example, estimation logic 604, speech suppressor 608, combining logic 610, modeling logic 702, processing logic 704, initialization logic 706, extraction logic 708, determination logic 710, filtering and smoothing logic 732, extraction logic 734, weight logic 736, combination logic 738, general weight module 740, speech weight module 742, beamforming logic 1302, block matrix logic 1304, NMF logic 1306, block matrix logic 1404, NMF logic 1406, speech suppressor 1502, and/or NMF logic 1504 may be implemented as hardware logic/electrical circuitry.

Figure 16:
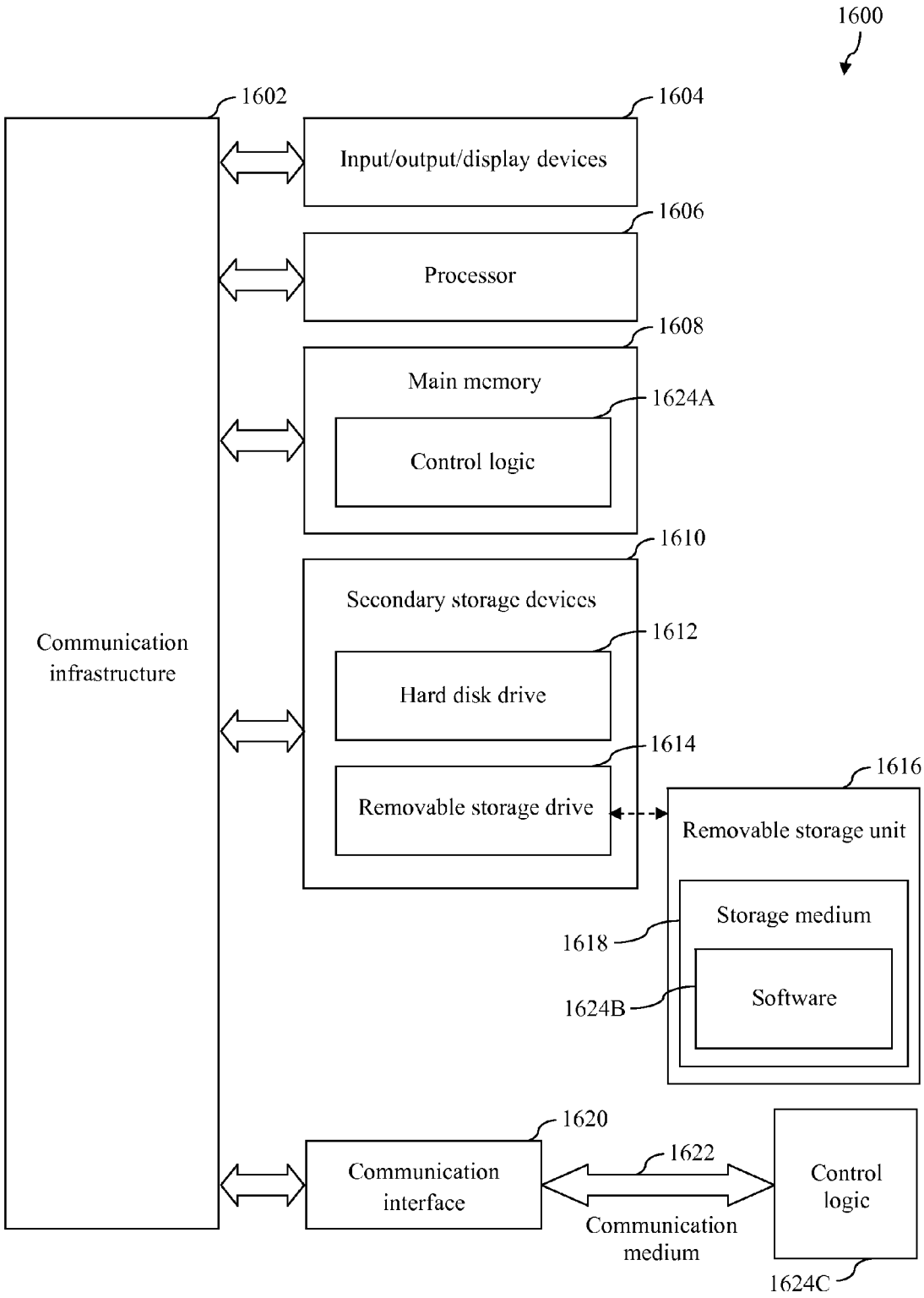
FIG. 16 is a block diagram of a computer in which embodiments may be implemented.

For instance, FIG. 16 is a block diagram of a computer 1600 in which embodiments may be implemented. As shown in FIG. 16, computer 1600 includes one or more processors (e.g., central processing units (CPUs)), such as processor 1606. Processor 1606 may include estimation logic 604, speech suppressor 608, and/or combining logic 610 of FIG. 6; modeling logic 702, processing logic 704, initialization logic 706, extraction logic 708, determination logic 710, filtering and smoothing logic 732, extraction logic 734, weight logic 736, combination logic 738, general weight module 740, and/or speech weight module 742 of FIG. 7; beamforming logic 1302, block matrix logic 1304, and/or NMF logic 1306 of FIG. 13; block matrix logic 1404 and/or NMF logic 1406 of FIG. 14; and/or speech suppressor 1502 and/or NMF logic 1504; or any portion or combination thereof, for example, though the scope of the example embodiments is not limited in this respect. Processor 1606 is connected to a communication infrastructure 1602, such as a communication bus. In some example embodiments, processor 1606 can simultaneously operate multiple computing threads.

Computer 1600 also includes a primary or main memory 1608, such as a random access memory (RAM). Main memory has stored therein control logic 1624A (computer software), and data.

Computer 1600 also includes one or more secondary storage devices 1610. Secondary storage devices 1610 include, for example, a hard disk drive 1612 and/or a removable storage device or drive 1614, as well as other types of storage devices, such as memory cards and memory sticks. For instance, computer 1600 may include an industry standard interface, such as a universal serial bus (USB) interface for interfacing with devices such as a memory stick. Removable storage drive 1614 represents a floppy disk drive, a magnetic tape drive, a compact disk drive, an optical storage device, tape backup, etc.

Removable storage drive 1614 interacts with a removable storage unit 1616. Removable storage unit 1616 includes a computer useable or readable storage medium 1618 having stored therein computer software 1624B (control logic) and/or data. Removable storage unit 1616 represents a floppy disk, magnetic tape, compact disc (CD), digital versatile disc (DVD), Blue-ray disc, optical storage disk, memory stick, memory card, or any other computer data storage device. Removable storage drive 1614 reads from and/or writes to removable storage unit 1616 in a well known manner.

Computer 1600 also includes input/output/display devices 1604, such as monitors, keyboards, pointing devices, etc. For instance, input/output/display devices 1604 may include one or more primary sensors (e.g., first sensor 106) and/or one or more reference sensors (e.g., second sensor 108).

Computer 1600 further includes a communication or network interface 1620. Communication interface 1620 enables computer 1600 to communicate with remote devices. For example, communication interface 1620 allows computer 1600 to communicate over communication networks or mediums 1622 (representing a form of a computer useable or readable medium), such as local area networks (LANs), wide area networks (WANs), the Internet, cellular networks, etc. Network interface 1620 may interface with remote sites or networks via wired or wireless connections.

Control logic 1624C may be transmitted to and from computer 1600 via the communication medium 1622.

Any apparatus or manufacture comprising a computer useable or readable medium having control logic (software) stored therein is referred to herein as a computer program product or program storage device. This includes, but is not limited to, computer 1600, main memory 1608, secondary storage devices 1610, and removable storage unit 1616. Such computer program products, having control logic stored therein that, when executed by one or more data processing devices, cause such data processing devices to operate as described herein, represent embodiments of the invention.

Devices in which embodiments may be implemented may include storage, such as storage drives, memory devices, and further types of computer-readable media. Examples of such computer-readable storage media include a hard disk, a removable magnetic disk, a removable optical disk, flash memory cards, digital video disks, random access memories (RAMs), read only memories (ROM), and the like. As used herein, the terms "computer program medium" and "computer-readable medium" are used to generally refer to the hard disk associated with a hard disk drive, a removable magnetic disk, a removable optical disk (e.g., CDROMs, DVDs, etc.), zip disks, tapes, magnetic storage devices, micro-electromechanical systems-based (MEMS-based) storage devices, nanotechnology-based storage devices, as well as other media such as flash memory cards, digital video discs, RAM devices, ROM devices, and the like.

Such computer-readable storage media are distinguished from and non-overlapping with communication media. Communication media typically embodies computer-readable instructions, data structures, program modules or other data in a modulated data signal such as a carrier wave. The term "modulated data signal" means a signal that has one or more of its characteristics set or changed in such a manner as to encode information in the signal. By way of example, and not limitation, communication media includes wireless media such as acoustic, RF, infrared and other wireless media. Example embodiments are also directed to such communication media.

Such computer-readable storage media may store program modules that include computer program logic for estimation logic 604, speech suppressor 608, and/or combining logic 610, modeling logic 702, processing logic 704, initialization logic 706, extraction logic 708, determination logic 710, filtering and smoothing logic 732, extraction logic 734, weight logic 736, combination logic 738, general weight module 740, speech weight module 742, beamforming logic 1302, block matrix logic 1304, NMF logic 1306, block matrix logic 1404, NMF logic 1406, speech suppressor 1502, and/or NMF logic 1504, flowchart 300 (including any one or more steps of flowchart 300), flowchart 400 (including any one or more steps of flowchart 400), flowchart 500 (including any one or more steps of flowchart 500), flowchart 800 (including any one or more steps of flowchart 800), flowchart 900 (including any one or more steps of flowchart 900), flowchart 1000 (including any one or more steps of flowchart 1000), flowchart 1100 (including any one or more steps of flowchart 1100), and/or flowchart 1200 (including any one or more steps of flowchart 1200); and/or further embodiments described herein. Some example embodiments are directed to computer program products comprising such logic (e.g., in the form of program code or software) stored on any computer useable medium. Such program code, when executed in one or more processors, causes a device to operate as described herein.

The invention can be put into practice using software, firmware, and/or hardware implementations other than those described herein. Any software, firmware, and hardware implementations suitable for performing the functions described herein can be used.

III. Conclusion

While various embodiments have been described above, it should be understood that they have been presented by way of example only, and not limitation. It will be understood by those skilled in the relevant art(s) that various changes in form and details may be made to the embodiments described herein without departing from the spirit and scope of the invention as defined in the appended claims. Accordingly, the breadth and scope of the present invention should not be limited by any of the above-described exemplary embodiments, but should be defined only in accordance with the following claims and their equivalents.

What is claimed is:

1. A method comprising:

estimating noise basis vectors with respect to a noise signal that is received from a first sensor of a communication device that is configured to be distal a mouth of a user during operation of the communication device to provide a noise model that represents noise provided by audio sources other than the user;

estimating speech basis vectors, speech weights that correspond to the speech basis vectors, and noise weights that correspond to the noise basis vectors based on a noisy speech signal that is received from a second sensor of the communication device that is configured to be proximate the mouth of the user during the operation of the communication device and further based on the noise basis vectors using a non-negative matrix factorization technique, the noisy speech signal representing a combination of speech and the noise; and estimating a clean speech signal based on the speech basis vectors and the speech weights, the clean speech signal representing the speech without the noise.

2. The method of claim 1, wherein estimating the noise basis vectors comprises:

estimating the noise basis vectors using a non-negative matrix factorization technique.

3. The method of claim 1, wherein estimating the noise basis vectors comprises:

estimating the noise basis vectors using a clustering technique.

4. The method of claim 1, wherein estimating the noise basis vectors comprises:

applying a blocking matrix to a plurality of signals that are received from a plurality of respective sensors of the communication device to suppress indications of the speech therein, the plurality of signals including the noise signal and the noisy speech signal.

5. The method of claim 1, wherein estimating the noise basis vectors comprises:

estimating the noise basis vectors on-line based on current and past samples of the noise signal at each time instance of successive time instances to provide respective estimates of the noise basis vectors;

wherein estimating the speech basis vectors, the speech weights, and the noise weights comprises:

estimating the speech basis vectors, the speech weights, and the noise weights on-line based on current and past samples of the noisy speech signal at each of the successive time instances based on the noise basis vectors to provide respective estimates of the speech basis vectors, respective estimates of the speech weights, and respective estimates of the noise weights; and wherein estimating the clean speech signal comprises:

estimating successive portions of the clean speech signal that correspond to the respective time instances based on the respective estimates of the speech basis vectors and the respective estimates of the speech weights.

6. The method of claim 5, wherein estimating the successive portions of the clean speech signal comprises:

estimating current samples of the clean speech signal comprising:

identifying a subset of the speech weights that corresponds to the current samples of the noisy speech signal; and estimating the clean speech signal based on the subset of the speech weights and the speech basis vectors.

7. The method of claim 1, wherein estimating the speech basis vectors comprises:

estimating the speech basis vectors off-line to provide respective estimates of the speech basis vectors;

storing the estimates of the speech basis vectors to be used on-line for estimating a subsequent clean speech signal during a subsequent operation of the communication device.

8. A method comprising:

estimating noise basis vectors representing a noise component; and estimating speech basis vectors representing a clean speech component;

estimating speech weights that correspond to the speech basis vectors and noise weights that correspond to the noise basis vectors based on a noisy speech signal, the noise basis vectors, and the speech basis vectors using a non-negative matrix factorization technique; and estimating a clean speech signal based on the speech basis vectors and the speech weights, the clean speech signal representing the clean speech component.

9. The method of claim 8, wherein estimating the noise basis vectors comprises:

performing a speech suppression technique with respect to a plurality of signals to suppress indications of speech therein to provide at least one speech-suppressed noise signal; and determining the noise component based on the at least one speech-suppressed noise signal.

10. The method of claim 8, wherein estimating the noise basis vectors comprises:

estimating the noise basis vectors on-line based on current and past samples of a noise signal that includes the noise component with regard to each of the successive time instances to provide the respective estimates of the noise basis vectors;

wherein estimating the speech basis vectors comprises:

estimating the speech basis vectors on-line based on current and past samples of the noisy speech signal at each of the successive time instances to provide the respective estimates of the speech basis vectors;

wherein estimating the speech weights and the noise weights comprises:

estimating the speech weights and the noise weights on-line based on the current and past samples of the noisy speech signal, the respective estimates of the noise basis vectors, and the respective estimates of the speech basis vectors; and wherein estimating the clean speech signal comprises:

estimating successive portions of the clean speech signal comprising:

identifying a subset of the speech weights that corresponds to the current samples of the noisy speech signal; and estimating the clean speech signal based on the respective estimates of the speech basis vectors and respective subsets of the speech weights that correspond to respective current samples of the noisy speech signal.

11. The method of claim 8, wherein estimating the speech basis vectors comprises:

estimating the speech basis vectors off-line to provide respective estimates of the speech basis vectors;

storing the estimates of the speech basis vectors to be used on-line for estimating a subsequent clean speech signal.

12. The method of claim 8, wherein estimating the noise basis vectors comprises:

calculating amplitude modulation spectra of a noise signal that includes the noise component; and approximating the amplitude modulation spectra of the noise signal based on the noise basis vectors multiplied by the noise weights; and wherein estimating the speech basis vectors comprises:

calculating amplitude modulation spectra of the noisy speech signal; and approximating the amplitude modulation spectra of the noisy speech signal based on a combination of the estimated noise basis vectors and the speech basis vectors multiplied by a combination of the noise weights and the speech weights.

13. The method of claim 8, wherein estimating the noise basis vectors comprises:

calculating magnitude spectra of a noise signal that includes the noise component; and approximating the magnitude spectra of the noise signal based on the noise basis vectors multiplied by the noise weights; and wherein estimating the speech basis vectors comprises:

calculating magnitude spectra of the noisy speech signal; and approximating the magnitude spectra of the noisy speech signal based on a combination of the estimated noise basis vectors and the speech basis vectors multiplied by a combination of the noise weights and the speech weights.

14. The method of claim 8, wherein estimating the noise basis vectors comprises:

calculating power spectra of a noise signal that includes the noise component; and approximating the power spectra of the noise signal based on the noise basis vectors multiplied by the noise weights; and wherein estimating the speech basis vectors comprises:

calculating power spectra of the noisy speech signal; and approximating the power spectra of the noisy speech signal based on a combination of the estimated noise basis vectors and the speech basis vectors multiplied by a combination of the noise weights and the speech weights.

15. A method comprising:

estimating noise basis vectors with respect to a noise signal that is part of a noisy speech signal, the noisy speech signal representing a combination of noise and speech, comprising:

applying a blocking matrix to a plurality of signals that are received from a plurality of respective sensors of a communication device to suppress indications of the speech therein to obtain an estimate of the noise signal;

estimating speech basis vectors, speech weights that correspond to the speech basis vectors, and noise weights that correspond to the noise basis vectors based on the noisy speech signal and further based on the noise basis vectors using a non-negative matrix factorization technique; and estimating a clean speech signal based on the speech basis vectors and the speech weights, the clean speech signal representing the speech without the noise.

16. The method of claim 15, wherein estimating the noise basis vectors comprises:

estimating the noise basis vectors using a non-negative matrix factorization technique.

17. The method of claim 15, wherein estimating the noise basis vectors comprises:

estimating the noise basis vectors using a clustering technique.

18. The method of claim 15, wherein estimating the speech basis vectors comprises:

enhancing indications of the speech in the plurality of signals that are received from the plurality of respective sensors based on a beamforming technique.

19. The method of claim 15, wherein estimating the noise basis vectors comprises:

estimating the noise basis vectors on-line based on current and past samples of the noise signal at each time instance of successive time instances to provide respective estimates of the noise basis vectors;

wherein estimating the speech basis vectors, the speech weights, and the noise weights comprises:

estimating the speech basis vectors, the speech weights, and the noise weights on-line based on current and past samples of the noisy speech signal at each of the successive time instances to provide respective estimates of the speech basis vectors, respective estimates of the speech weights, and respective estimates of the noise weights;

wherein estimating the clean speech signal comprises:

estimating successive portions of the clean speech signal that correspond to the respective time instances based on the respective estimates of the speech basis vectors, the respective estimates of the noise basis vectors, and the respective estimates of the speech weights; and wherein estimating the successive portions of the clean speech signal comprises:

estimating current samples of the clean speech signal comprising:

identifying a subset of the speech weights that corresponds to the current samples of the noisy speech signal; and estimating the clean speech signal based on the speech basis vectors and the subset of the speech weights.

20. The method of claim 15, wherein estimating the speech basis vectors comprises:

estimating the speech basis vectors off-line to provide respective estimates of the speech basis vectors;

storing the estimates of the speech basis vectors to be used on-line for estimating a subsequent clean speech signal.

* * * * *